US009524670B2

(12) United States Patent
Park et al.

(10) Patent No.: US 9,524,670 B2
(45) Date of Patent: Dec. 20, 2016

(54) DISPLAY APPARATUS INCLUDING DUMMY PIXELS AND REPAIR LINES

(71) Applicant: Samsung Display Co., Ltd., Yongin, Gyeonggi-do (KR)

(72) Inventors: Kyoung-Tae Park, Yongin (KR); Tae-Gon Kim, Yongin (KR); Warrick So, Yongin (KR); Sung-Ho Cho, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 14/466,867

(22) Filed: Aug. 22, 2014

(65) Prior Publication Data

US 2015/0262526 A1 Sep. 17, 2015

(30) Foreign Application Priority Data

Mar. 12, 2014 (KR) ..... 10-2014-0029273

(51) Int. Cl.
*G09G 3/32* (2016.01)

(52) U.S. Cl.
CPC .... *G09G 3/3233* (2013.01); *G09G 2300/0413* (2013.01); *G09G 2300/0861* (2013.01); *G09G 2330/08* (2013.01)

(58) Field of Classification Search
CPC ..... G09G 3/3233; G09G 2330/10; G09G 2330/08; G09G 3/3258
USPC ..... 345/76
See application file for complete search history.

(56) References Cited

U.S. PATENT DOCUMENTS

2008/0036386 A1 2/2008 Shin et al.
2009/0309516 A1* 12/2009 Kim ..... G09G 3/3233 315/307
2010/0207106 A1 8/2010 Lhee et al.
2013/0201172 A1* 8/2013 Jeong ..... G09G 3/3233 345/212

(Continued)

FOREIGN PATENT DOCUMENTS

KR 10-0666639 B1 1/2007
KR 10-0740133 B1 7/2007

(Continued)

*Primary Examiner* — Jonathan Blancha
(74) *Attorney, Agent, or Firm* — Lewis Roca Rothgerber Christie LLP

(57) ABSTRACT

A display apparatus includes: pixels at a display area; dummy pixels at a dummy area; and repair lines coupled to the dummy pixels and connectably arranged to the pixels, each of the dummy pixels including: a driving transistor configured to output a driving current corresponding to a data signal applied to a gate electrode thereof; an emission control transistor between a connection node of a corresponding repair line of the repair lines and the driving transistor, configured to be controlled by an emission control signal; a bypass transistor between the connection node and a first initialization voltage line through which a first initialization voltage is supplied, configured to be controlled by an initialization control signal; and a coupling removal transistor between the connection node and the first initialization voltage line, configured to be controlled by a coupling control signal applied at a different timing from the initialization control signal.

13 Claims, 20 Drawing Sheets

(56) References Cited

U.S. PATENT DOCUMENTS

| | | | | |
|---|---|---|---|---|
| 2014/0034923 | A1* | 2/2014 | Kim | H01L 27/3297 257/40 |
| 2014/0068925 | A1* | 3/2014 | Park | G02F 1/1309 29/593 |
| 2014/0292827 | A1* | 10/2014 | Kang | G09G 3/20 345/690 |
| 2015/0022513 | A1* | 1/2015 | Kim | G09G 3/22 345/212 |
| 2015/0084014 | A1 | 3/2015 | Kim et al. | |
| 2015/0087081 | A1 | 3/2015 | Kim et al. | |
| 2015/0102302 | A1 | 4/2015 | Kim et al. | |
| 2015/0102312 | A1 | 4/2015 | Lee et al. | |
| 2015/0102985 | A1 | 4/2015 | Kim et al. | |
| 2015/0170562 | A1 | 6/2015 | In et al. | |
| 2015/0262526 | A1 | 9/2015 | Park et al. | |

FOREIGN PATENT DOCUMENTS

| | | | |
|---|---|---|---|
| KR | 10-2010-0093220 | A | 8/2010 |
| KR | 10-2015-0033152 | | 4/2015 |
| KR | 10-2015-0033153 | | 4/2015 |
| KR | 10-2015-0042355 | | 4/2015 |
| KR | 10-2015-0042602 | | 4/2015 |
| KR | 10-2015-0044328 | | 4/2015 |
| KR | 10-2015-0069921 | | 6/2015 |
| KR | 10-2015-0107018 | | 9/2015 |

* cited by examiner

DISPLAY APPARATUS INCLUDING DUMMY PIXELS AND REPAIR LINES

CROSS-REFERENCE TO RELATED APPLICATION

This application claims priority to and the benefit of Korean Patent Application No. 10-2014-0029273, filed on Mar. 12, 2014, in the Korean Intellectual Property Office, the entire content of which is incorporated herein in its entirety by reference.

BACKGROUND

1. Field

One or more embodiments of the present invention relate to a display apparatus.

2. Description of the Related Art

When a pixel becomes defective, the pixel may constantly emit light regardless of a scan signal or a data signal applied thereto or may display just a black color. As such, a user sees a pixel constantly emitting light as a bright spot (or a white spot), and a pixel displayed as a black color is seen by a viewer as a dark spot (or a black spot).

According to the complexity of a pixel circuit, it is difficult to repair a bright spot or a dark spot caused by a defective pixel circuit.

SUMMARY

One or more embodiments of the present invention include a display apparatus of which defective pixels may normally operate by repairing them, thereby increasing production throughout and reducing quality deterioration when the display apparatus is manufactured.

Additional aspects will be set forth in part in the description which follows and, in part, will be apparent from the description, or may be learned by practice of the presented embodiments.

According to one or more embodiments of the present invention, there is provided a display apparatus including: a plurality of pixels at a display area; a plurality of dummy pixels at a dummy area; and a plurality of repair lines coupled to the plurality of dummy pixels and connectably arranged to the plurality of pixels, wherein each of the dummy pixels includes: a driving transistor configured to output a driving current corresponding to a data signal applied to a gate electrode thereof; an emission control transistor coupled between a connection node of a corresponding repair line from among the plurality of repair lines and the driving transistor, the emission control transistor being configured to be controlled by an emission control signal; a bypass transistor coupled between the connection node and a first initialization voltage line through which a first initialization voltage is supplied, the bypass transistor being configured to be controlled by an initialization control signal; and a coupling removal transistor coupled between the connection node and the first initialization voltage line, the coupling removal transistor being configured to be controlled by a coupling control signal applied at a different timing from the initialization control signal.

When one of the plurality of dummy pixels is coupled to a defective pixel of the plurality of pixels through a corresponding first repair line of the repair lines, the coupling control signal for turning on the coupling removal transistor may be applied in correspondence with a level change time point of a control signal applied to first pixels of the plurality of pixels, which are arranged along the first repair line, through at least one control line arranged in parallel with the first repair line, or in correspondence with an emission time point of the first pixels.

The each of the dummy pixels may further include: an initialization transistor coupled between the gate electrode of the driving transistor and the first initialization voltage line, the initialization transistor being configured to be controlled by the initialization control signal; a switching transistor coupled between a data line through which the data signal is applied and a first electrode of the driving transistor, the switching transistor being configured to be controlled by a scan signal; and a compensation transistor coupled between the gate electrode and a second electrode of the driving transistor, the compensation transistor being configured to be controlled by the scan signal.

The coupling control signal may be the scan signal, a first next scan signal following the scan signal after one unit of time, or a second next scan signal following the scan signal after two units of time.

In each of the dummy pixels, the initialization transistor and the bypass transistor may be configured to be turned on during an initialization period and to initialize the gate electrode of the driving transistor and the corresponding repair line coupled to the connection node, the switching transistor and the compensation transistor may be configured to be turned on during a data write period and to apply a dummy data signal in which a threshold value of the driving transistor is compensated for to the gate electrode of the driving transistor, the emission control transistor may be configured to be turned on during an emission period and to output the driving current to the corresponding repair line, and the coupling removal transistor may be turned on during a coupling removal period and to remove a coupling voltage from the initialized corresponding repair line.

Each of the pixels may include: a second driving transistor configured to output a driving current corresponding to a data signal applied to a gate electrode thereof; a second emission control transistor coupled between the second driving transistor and a light-emitting device, the second emission transistor being configured to be controlled by a second emission control signal; a second bypass transistor coupled between the light-emitting device and a second initialization voltage line through which a second initialization voltage is supplied, the second bypass transistor being configured to be controlled by a second initialization control signal; a second initialization transistor coupled between the gate electrode of the second driving transistor and the second initialization voltage line, the second initialization transistor being configured to be controlled by the second initialization control signal; a second switching transistor coupled between a data line through which the data signal is applied and a first electrode of the second driving transistor, the second switching transistor being configured to be controlled by a second scan signal; and a second compensation transistor coupled between the gate electrode and a second electrode of the second driving transistor, the second compensation transistor being configured to be controlled by the second scan signal, wherein the second initialization voltage is higher than the first initialization voltage.

The second emission control signal may be an nth emission control signal, and the emission control signal may be the nth emission control signal or an (n+1)th emission control signal, the second initialization control signal may be an nth initialization control signal, and the initialization control signal may be the nth initialization control signal or an (n+1)th initialization control signal, and the second scan signal and the scan signal may be an nth scan signal.

Each of the dummy pixels may further include a boost capacitor coupled between a gate electrode of the coupling removal transistor and the corresponding repair line.

Each of the dummy pixels may further include: an initialization transistor coupled between the gate electrode of the driving transistor and the first initialization voltage line, the initialization transistor being configured to be controlled by the initialization control signal; a switching transistor coupled between a data line through which the dummy data signal is applied and a first electrode of the driving transistor, the switching transistor being configured to be controlled by a scan signal; and a compensation transistor coupled between the gate electrode and a second electrode of the driving transistor, the compensation transistor being configured to be controlled by the scan signal.

The coupling control signal may be the scan signal, a first next scan signal following the scan signal after one unit of time, or a second next scan signal following the scan signal after two units of time.

In each of the dummy pixels, the initialization transistor and the bypass transistor may be configured to be turned on during an initialization period and to initialize the gate electrode of the driving transistor and the corresponding repair line coupled to the connection node, the switching transistor and the compensation transistor may be configured to be turned on during a data write period and to apply a dummy data signal in which a threshold value of the driving transistor is compensated to the gate electrode of the driving transistor, the emission control transistor may be configured to be turned on during an emission period and to output the driving current to the corresponding repair line, the coupling removal transistor may be configured to be turned on during a coupling removal period and to remove a coupling voltage of the initialized corresponding repair line, and the boost capacitor is configured to boost the corresponding repair line after the coupling removal period.

Each of the pixels may include: a second driving transistor configured to output a driving current corresponding to a data signal applied to a gate electrode thereof; a second emission control transistor coupled between the second driving transistor and a light-emitting device, the second emission control transistor being configured to be controlled by a second emission control signal; a second bypass transistor coupled between the light-emitting device and a second initialization voltage line through which a second initialization voltage is supplied, the second bypass transistor being configured to be controlled by a second initialization control signal; a second initialization transistor coupled between the gate electrode of the second driving transistor and the second initialization voltage line, the second initialization transistor being configured to be controlled by the second initialization control signal; a second switching transistor coupled between a data line through which the data signal is applied and a first electrode of the second driving transistor, the second switching transistor being configured to be controlled by a second scan signal; and a second compensation transistor coupled between the gate electrode and a second electrode of the second driving transistor, the second compensation transistor being configured to be controlled by the second scan signal, wherein the second initialization voltage is the same as the first initialization voltage.

According to another embodiment of the present invention, there is provided a display apparatus: a plurality of pixels at a display area; a plurality of dummy pixels at a dummy area; and a plurality of repair lines coupled to the plurality of dummy pixels and connectably arranged to the plurality of pixels, wherein each of the dummy pixels includes: a driving transistor configured to output a driving current corresponding to a data signal applied to a gate electrode thereof; an emission control transistor coupled between a connection node of a corresponding repair line from among the plurality of repair lines and the driving transistor, the emission control transistor being configured to be controlled by an emission control signal; and a coupling removal transistor coupled between the connection node and a first initialization voltage line through which a first initialization voltage is supplied, the coupling removal transistor being configured to be controlled by a coupling control signal that is an inverted signal of the emission control signal.

When one of the plurality of dummy pixels is coupled to a defective pixel of the plurality of pixels through a corresponding first repair line of the repair lines, the coupling control signal may turn on the coupling removal transistor while the emission control transistor is configured to be turned off by the emission control signal, to maintain the first repair line at the first initialization voltage.

Each of the dummy pixels may further include: an initialization transistor coupled between the gate electrode of the driving transistor and the first initialization voltage line, the initialization transistor being configured to be controlled by the initialization control signal; a switching transistor coupled between a data line through which the data signal is applied and a first electrode of the driving transistor, the switching transistor being configured to be controlled by a scan signal; and a compensation transistor coupled between the gate electrode and a second electrode of the driving transistor, the compensation transistor being configured to be controlled by the scan signal.

Each of the dummy pixels may further include a bypass transistor coupled between the connection node and the first initialization voltage line, the bypass transistor being configured to be controlled by the initialization control signal.

The display apparatus of claim 15, wherein each of the pixels includes: a second driving transistor configured to output a driving current corresponding to a data signal applied to a gate electrode thereof; a second emission control transistor coupled between the second driving transistor and a light-emitting device, the second emission control transistor being configured to be controlled by a second emission control signal; a second bypass transistor coupled between the light-emitting device and a second initialization voltage line through which a second initialization voltage is supplied, the second bypass transistor being configured to be controlled by a second initialization control signal; a second initialization transistor coupled between the gate electrode of the second driving transistor and the second initialization voltage line, the second initialization transistor being configured to be controlled by the second initialization control signal; a second switching transistor coupled between a data line through which the data signal is applied and a first electrode of the second driving transistor, the second switching transistor being configured to be controlled by a second scan signal; and a second compensation transistor coupled between the gate electrode and a second electrode of the second driving transistor, the second compensation transistor being configured to be controlled by the second scan signal, wherein the second initialization voltage is higher than the first initialization voltage.

Each of the pixels may include: a second driving transistor configured to output a driving current corresponding to a data signal applied to a gate electrode thereof; a second emission control transistor coupled between the second driving transistor and a light-emitting device, the second emission control transistor being configured to be controlled by a second emission control signal; a second bypass transistor coupled between the light-emitting device and a second initialization voltage line through which a second initialization voltage is supplied, the second bypass transistor being configured to be controlled by a second initialization control signal; a second initialization transistor coupled between the gate electrode of the second driving transistor and the second initialization voltage line, the second initialization transistor being configured to be controlled by the second initialization control signal; a second switching transistor coupled between a data line through which the data signal is applied and a first electrode of the second driving transistor, the second switching transistor being configured to be controlled by a second scan signal; and a second compensation transistor coupled between the gate electrode and a second electrode of the second driving transistor, the second compensation transistor being configured to be controlled by the second scan signal, wherein the second initialization voltage is higher than the first initialization voltage.

The second emission control signal may be an nth emission control signal, and the emission control signal may be the nth emission control signal or an (n+1)th emission control signal, the second initialization control signal may be an nth initialization control signal, and the initialization control signal may be the nth initialization control signal or an (n+1)th initialization control signal, and the second scan signal and the scan signal may be an nth scan signal.

According to another embodiment of the present invention, there is provided a display apparatus including: a plurality of pixels at a display area; a plurality of dummy pixels at a non-display area; and a plurality of repair lines coupled to the plurality of dummy pixels and connectably arranged to the plurality of pixels, wherein each of the dummy pixels includes: a dummy circuit configured to output a driving current corresponding to a data signal to a coupled corresponding repair line; and a coupling removal transistor coupled to the coupled corresponding repair line and configured to be turned on in correspondence with a level change time point of a control signal applied to first pixels of the plurality of pixels, which are arranged along the corresponding repair line, through at least one control line arranged in parallel with the corresponding repair line, or in correspondence with an emission time point of the first pixels.

Each of the dummy pixels may further include a boost capacitor coupled between a gate electrode of the coupling removal transistor and the corresponding repair line.

BRIEF DESCRIPTION OF THE DRAWINGS

These and/or other aspects of the present invention will become apparent and more readily appreciated from the following description of the embodiments, taken in conjunction with the accompanying drawings in which.

DETAILED DESCRIPTION

Figure 1:
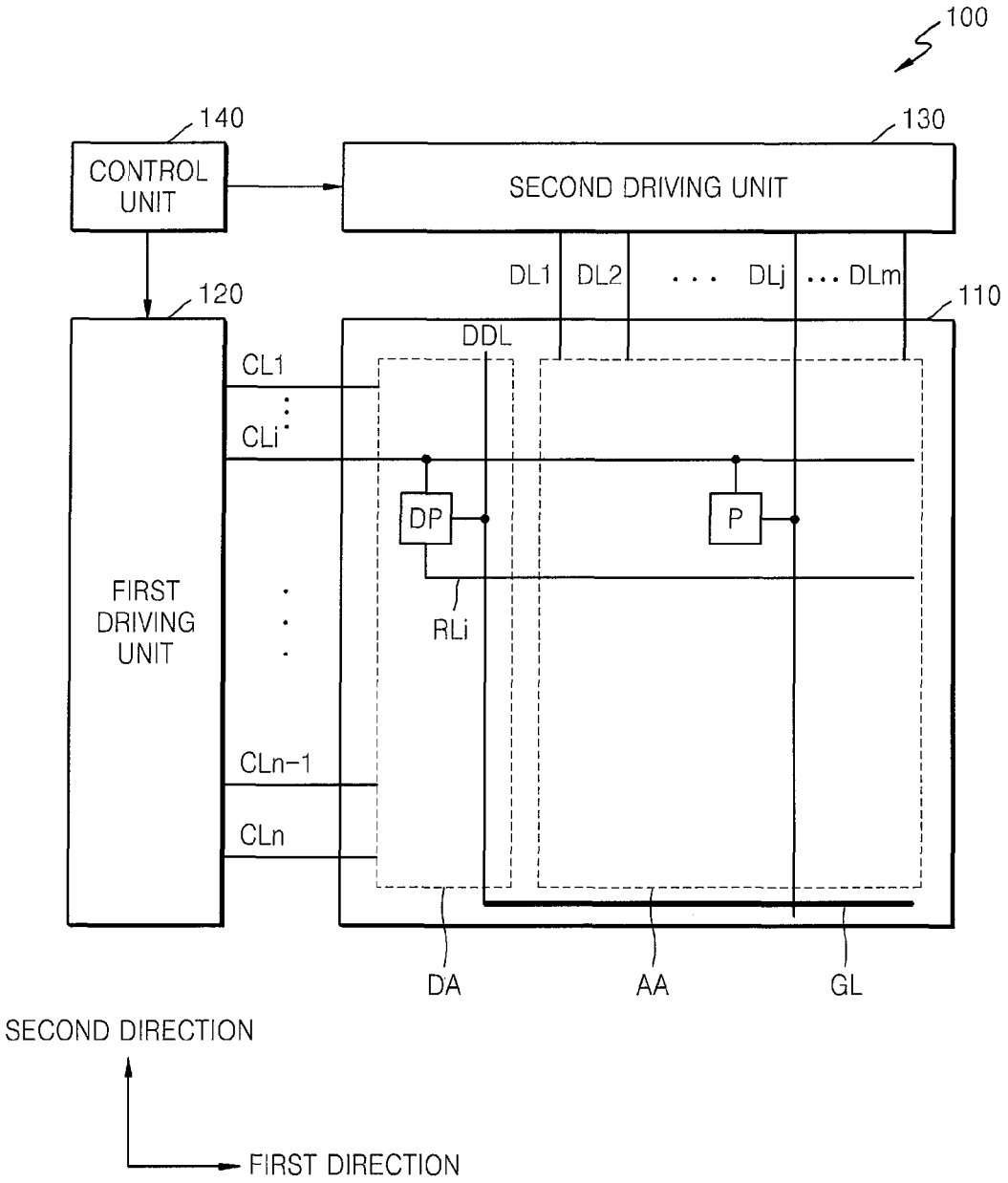
FIG. 1 is a schematic block diagram of a display apparatus according to an embodiment of the present invention.

The present invention may allow various changes in form, and example embodiments thereof will be illustrated in drawings and described in detail in the specification. The effects and features of the present invention and a method of achieving the same will be clear by referring to the embodiments, examples of which are illustrated in the accompanying drawings. However, the example embodiments do not limit the present invention but may be modified within the spirit and technical scope of the present invention.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description.

It will be understood that although the terms "first", "second", etc. may be used herein to describe various components, these components should not be limited by these terms. These components are only used to distinguish one component from another. As used herein, the singular forms "a," "an" and "the" are intended to include the plural forms as well, unless the context clearly indicates otherwise.

It will be further understood that the terms "comprises" and/or "comprising" used herein specify the presence of stated features or components, but do not preclude the presence or addition of one or more other features or components. When a first element is described as being "coupled" or "connected" to a second element, the first element may be directly "coupled" or "connected" to the second element, or one or more other intervening elements may be located between the first element and the second element.

As used herein, the term "and/or" includes any and all combinations of one or more of the associated listed items.

FIG. 1 is a schematic block diagram of a display apparatus 100 according to an embodiment of the present invention.

Referring to FIG. 1, the display apparatus 100 includes a display panel 110, a first driving unit (or first driver) 120, a second driving unit (or second driver) 130, and a control unit (or controller) 140. The first driving unit 120, the second driving unit 130, and the control unit 140 may be formed as individual semiconductor chips or integrated in one semiconductor chip. The first driving unit 120 and/or the second driving unit 130 may be formed on the same substrate as the display panel 110.

The display apparatus 100 may be a flat display apparatus, such as an organic light-emitting diode (OLED) display, a thin-film transistor liquid crystal display (TFT-LCD), a plasma display panel (PDP), or a light-emitting diode (LED) display apparatus, but is not limited thereto. Hereinafter, an OLED display apparatus will be described as an example. The display apparatus 100 may be used for displaying an image in an electronic device, e.g., a smartphone, tablet PC, laptop PC, monitor, TV, and the like.

An active area (e.g., display area) AA and a dummy area DA may be defined at the display panel 110. The dummy area DA may be arranged in a non-display area that is adjacent to the active area AA. The dummy area DA may be arranged to the left and/or the right of the active area AA. In another example, the dummy area DA may be arranged at the top and/or the bottom of the active area AA.

A plurality of pixels P coupled to a plurality of control lines CL1 to CLn extending along a first direction (for example, a row direction) and a plurality of data lines DL1 to DLm extending along a second direction (for example, a column direction) may be arranged in the active area AA. A plurality of dummy pixels DP, each coupled to a dummy data line DDL and a corresponding one (e.g., CLi) of the plurality of control lines CL1 to CLn may be arranged in the dummy area DA. The plurality of dummy pixels DP may be arranged along the second direction in the dummy area DA.

FIG. 1 shows the plurality of control lines CL1 to CLn as one signal line for convenience of description. However, each of the plurality of control lines CL1 to CLn may include a plurality of signal lines. For example, a first control line CL1 may include three lines through which a scan signal GW, an initialization control signal GI, and an emission control signal EM are respectively transmitted.

The display panel 110 may include a plurality of repair lines RL1 to RLn extending in parallel to the plurality of control lines CL1 to CLn. The plurality of repair lines RL1 to RLn may be coupled to the plurality of dummy pixels DP and may also be connectably arranged to the plurality of pixels P.

In order to display various colors, a unit pixel may include a plurality of sub-pixels for respectively displaying a plurality of colors. In the specification, the pixel P primarily indicates one sub-pixel. However, the present embodiment is not limited thereto, and the pixel P may indicate one unit pixel including a plurality of sub-pixels. That is, when the description of the present specification refers to one pixel P, it may be understood that the description refers to one sub-pixel or a plurality of sub-pixels that form one unit pixel. The same concept as described above also applies to the dummy pixel DP. Thus, when the specification refers to one dummy pixel DP, it may be understood that the specification refers to one dummy sub-pixel or a plurality of dummy sub-pixels corresponding to a number of sub-pixels forming one unit pixel. When it is understood that the one dummy pixel indicates a plurality of dummy sub-pixels, it may be understood that a dummy data line coupled to the dummy pixel also includes a plurality of dummy data lines respectively coupled to the plurality of dummy sub-pixels.

In the specification, the term "connectable" or "connectably" indicates a connectable state when a laser or the like is used in or during a repair process. For example, a first member and a second member, which are connectably arranged to each other, indicate that the first member and the second member are not actually coupled to each other but are in a state where the first member and the second member may be coupled to each other by a repair process. From a structural point of view, the first member and the second member "connectable" to each other may be arranged so as to cross each other by interposing an insulating layer therebetween in an overlap region. When a laser beam is irradiated on the overlap region in or during a repair process, the insulating layer in the overlap region is destroyed, thereby electrically coupling the first member and the second member to each other.

In addition, in the specification, the term "separable" or "separably" indicates a separable state when a laser or the like is used in or during a repair process. For example, a first member and a second member, which are separably coupled, indicate that the first member and the second member are actually coupled to each other but are in a state where the first member and the second member may be separated from each other in or during a repair process. From a structural point of view, the first member and the second member which are separably coupled may be arranged so as to be coupled to each other through a conductive connection member. When a laser beam is irradiated on the conductive connection member in or during a repair process, the conductive connection member melts and is cut at a portion on which the laser beam is irradiated, thereby electrically insulating the first member and the second member from each other. As an example, the conductive connection member may include a silicon layer which may be melted by a laser. In another example, the conductive connection member may be melted and cut via Joule heat generated by a current.

The display panel 110 may include a connection line GL coupled to the dummy data line DDL and connectably arranged to or with the plurality of data lines DL1 to DLm. The connection line GL may extend in the first direction. The connection line GL may be arranged (e.g., arranged in a dead space) outside the active area AA and the dummy area DA. The dead space is an area in the display panel 110 where the plurality of pixels P and the plurality of dummy pixels DP are not arranged. Since the connection line GL is arranged in the dead space, the connection line GL may be formed with a large design margin. For example, the connection line GL may have a large width and/or thickness to lower a resistance thereof. A plurality of connection lines GL may be arranged in the display panel 110.

The first driving unit 120 may provide a plurality of control signals to the plurality of pixels P and the plurality of dummy pixels DP via the plurality of control lines CL1 to CLn and also provide a data signal to the plurality of pixels P via the plurality of data lines DL1 to DLm. As shown in FIG. 1, the second driving unit 130 is not directly coupled to the dummy data line DDL. The control unit 140 may control the first driving unit 120 and the second driving unit 130 on the basis of (e.g., according to) a horizontal synchronization signal and a vertical synchronization signal. The control unit 140 may operate so that a first power source voltage ELVDD, a second power source voltage ELVSS, initialization voltages VINT and VINT2, and the like are applied to the plurality of pixels P and/or the plurality of dummy pixels DP.

Each pixel P may include a light-emitting device and a pixel circuit separably coupled to the light-emitting device. Each dummy pixel DP may include a dummy circuit. For example, when the pixel P shown in FIG. 1 is a defective pixel, a light-emitting device of the defective pixel may be separated from a pixel circuit of the defective pixel and coupled to a corresponding dummy pixel DP among the plurality of dummy pixels DP via a corresponding repair line RLi from among the plurality of repair lines RL1 to RLn. In addition, a data line DLj coupled to the defective pixel from among the plurality of data lines DL1 to DLm may be coupled to the dummy data line DDL via the connection line GL. A data signal to be applied to the defective pixel is applied to the corresponding dummy pixel DP via the data line DLj, the connection line GL coupled to the data line DLj, and the dummy data line DDL coupled to the connection line GL. The corresponding dummy pixel DP generates a driving current corresponding to the data signal and supplies the driving current to the light-emitting device of the defective pixel via the repair line RLi. The light-emitting device emits light of a brightness corresponding to the data signal. Therefore, the light-emitting device of the defective pixel operates normally by use of the corresponding dummy pixel DP.

In the specification, the term "corresponding" or "in correspondence with" may indicate an arrangement in the same column or row according to context. For example, a first member which is coupled to a "corresponding" second member from among a plurality of second members indicates that the first member is coupled to a second member arranged in the same column or row as the first member.

Figure 2:
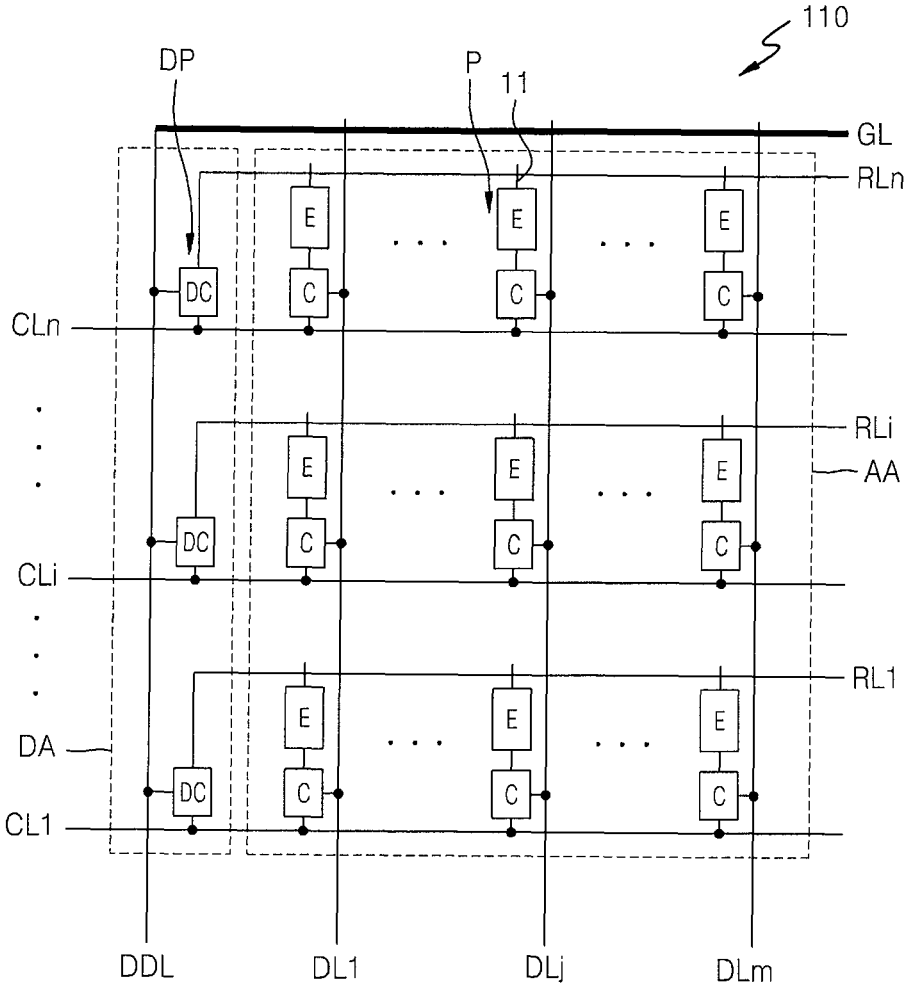
FIG. 2 is a circuit diagram of a display panel in the display apparatus shown in FIG. 1, according to an embodiment of the present invention.

FIG. 2 is a circuit diagram of the display panel 110 shown in FIG. 1, according to an embodiment of the present invention.

Referring to FIG. 2, the display panel 110 includes the active area AA and the dummy area DA around the active area AA.

A pixel P arranged in the active area AA includes a pixel circuit C and a light-emitting device E that emits light in response to a driving current received from the pixel circuit C. The light-emitting device E and the pixel circuit C may be separably coupled to each other. The pixel circuit C may include one or more thin-film transistors and capacitors. The pixel P emits light of a single color, e.g., a red, blue, green, or white color. However, the present embodiment is not limited thereto and the pixel P may emit light of a color other than the red, blue, green, and white colors.

The light-emitting device E of the pixel P is insulated from a repair line in the same row as the pixel P and may be electrically coupled to the repair line by a repair process in the future. That is, the light-emitting device E of the pixel P may be connectably arranged at the repair line in the same row as the pixel P. For example, the light-emitting device E may be formed so as to be electrically coupled to a first connection member 11, wherein a portion of the first connection member 11 overlaps the repair line via an insulating layer interposed therebetween. The first connection member 11 may include one or more conductive layers formed of a conductive material. When a laser beam is irradiated on an overlap region of the first connection member 11 and the repair line in a repair process, the insulating layer may be removed (e.g., destroyed), and therefore the first connection member 11 and the repair line become short-circuited and electrically coupled to each other. Accordingly, the light-emitting device E may become electrically coupled to the repair line.

In the embodiment of FIG. 2, an example where the dummy area DA is arranged to the left of the active area AA and one dummy pixel DP is arranged in each row is shown. The dummy data line DDL coupled to dummy pixels DP is arranged in the dummy area DA. The dummy data line DDL may be arranged in parallel to the plurality of data lines DL1 to DLm. The plurality of repair lines RL1 to RLn and the plurality of control lines CL1 to CLn extend even in the dummy area DA.

Each dummy pixel DP includes a dummy circuit DC but does not include a light-emitting device. The dummy circuit DC may be the same as the pixel circuit C. In another example, the dummy circuit DC may be different from the pixel circuit C. That is, the dummy circuit DC may not include and/or may include a transistor and/or a capacitor of the pixel circuit C or may have sizes and characteristics different from those of transistors and capacitors in the pixel circuit C.

The connection line GL may be arranged outside the active area AA and the dummy area DA. The connection line GL is insulated from the plurality of data lines DL1 to DLm, and the connection line GL and one of the plurality of data lines DL1 to DLm may be electrically coupled to each other in a repair process. For example, the plurality of data lines DL1 to DLm may be arranged so as to partially overlap the connection line GL by interposing an insulating layer therebetween. In a repair process, when a laser beam is irradiated on an overlap region of a data line coupled to a defective pixel and the connection line GL, the insulating layer may be removed (e.g., destroyed), and therefore the data line coupled to the defective pixel and the connection line GL become short-circuited and are electrically coupled to each other.

Figure 3:
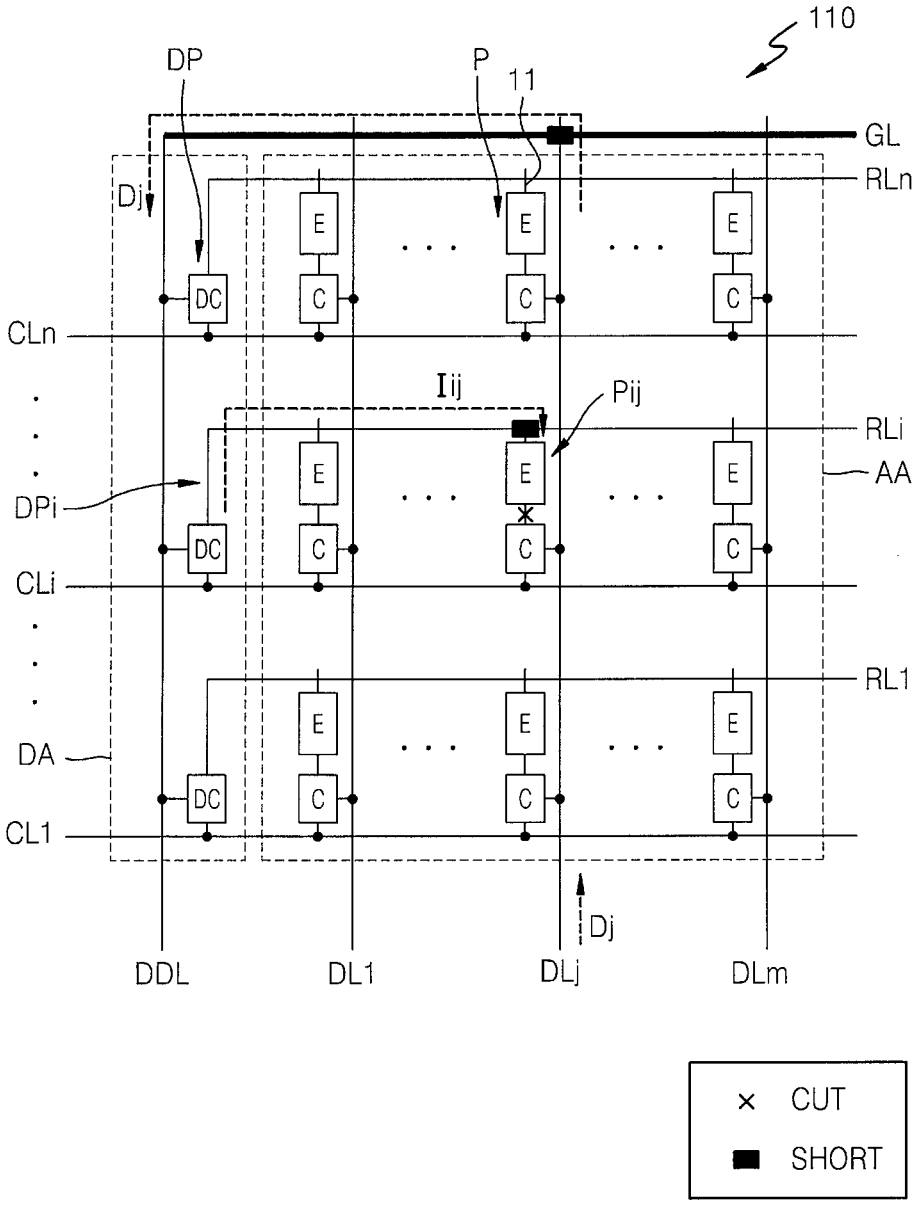
FIG. 3 is a circuit diagram for describing a method of repairing a defective pixel by using a repair line in the display panel shown in FIG. 2.

FIG. 3 is a circuit diagram for describing a method of repairing a defective pixel by using a repair line in the display panel 110 shown in FIG. 2.

A case where a pixel Pij coupled to an ith control line CLi and a jth data line DLj among the plurality of pixels P formed in the active area AA is defective, for example, a pixel circuit C of the pixel Pij is defective, will be described below as an example. In the example, the pixel Pij is referred to as a defective pixel Pij.

Referring to FIG. 3, a light-emitting device E of the defective pixel Pij is separated from the pixel circuit C. For example, when a laser beam is irradiated on a connection region of the light-emitting device E and the pixel circuit C, a connection between the light-emitting device E and the pixel circuit C is cut, and accordingly, the light-emitting device E of the defective pixel Pij may be separated from the pixel circuit C.

Thereafter, the light-emitting device E of the defective pixel Pij is electrically coupled to a dummy circuit DC of an ith dummy pixel DPi. To this end, the light-emitting device E of the defective pixel Pij is coupled to an ith repair line RLi in the same row as the defective pixel Pij. For example, the light-emitting device E is coupled to the ith repair line RLi by irradiating a laser beam on an overlap region of the first connection member 11 coupled to the light-emitting device E of the defective pixel Pij and the ith repair line RLi in the same row as the defective pixel Pij. Since the ith repair line RLi is coupled to the dummy circuit DC, the light-emitting device E of the defective pixel Pij is coupled to the dummy circuit DC of the ith dummy pixel DPi.

Thereafter, the jth data line DLj coupled to the defective pixel Pij is electrically coupled to the dummy data line DDL. To this end, the jth data line DLj is coupled to the connection line GL. For example, when a laser beam is irradiated on an overlap region of the jth data line DLj and the connection line GL, the jth data line DLj and the connection line GL become electrically coupled to each other. Since the connection line GL is coupled to the dummy data line DDL, the jth data line DLj and the dummy data line DDL are coupled to each other.

The pixel circuit C of the defective pixel Pij and the dummy circuit DC of the ith dummy pixel DPi concurrently (e.g., simultaneously) respond to a scan signal applied through the same scan line in the ith control line. Since the jth data line DLj coupled to the pixel circuit C of the defective pixel Pij is coupled to the dummy data line DDL via the connection line GL, a jth data signal Dj applied to the pixel circuit C of the defective pixel Pij is also applied to the dummy circuit DC of the ith dummy pixel DPi. The dummy circuit DC generates a driving current Iij corresponding to the jth data signal Dj and provides the driving current Iij to the light-emitting device E of the defective pixel Pij via the ith repair line RLi. The light-emitting device E of the defective pixel Pij emits light of a brightness corresponding to the jth data signal Dj by the driving current Iij. Accordingly, the defective pixel Pij may be repaired and operate as a normal pixel.

In the present embodiment, since the dummy data line DDL is coupled to the jth data line DLj via the connection line GL, the dummy data line DDL does not have to be separately driven. Accordingly, the second driving unit 130 does not have to be modified for a separate timing or to drive the dummy data line DDL, and an existing driving unit may be used for the second driving unit 130 as it is.

Figure 4:
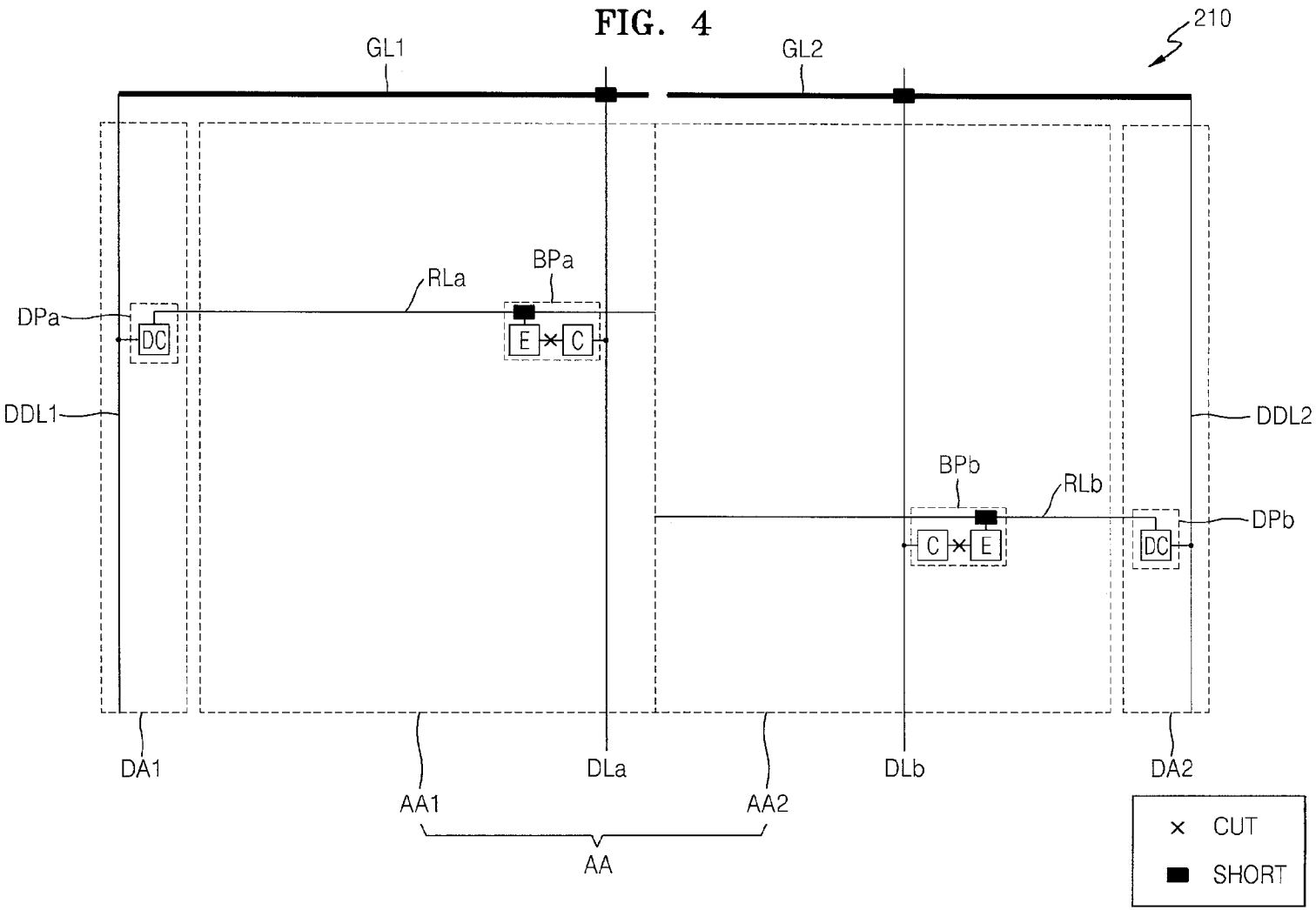
FIG. 4 is a circuit diagram of a display panel in the display apparatus shown in FIG. 1, according to another embodiment of the present invention.

FIG. 4 is a circuit diagram of a display panel 210 in the display apparatus 100 shown in FIG. 1, according to another embodiment of the present invention.

Referring to FIG. 4, the display panel 210 is substantially the same as the display panel 110 shown in FIG. 2 except for partial differences. Only these differences will be primarily described below. In addition, for easy understanding of the present embodiment, FIG. 4 shows defective pixels BPa and BPb without showing normal pixels P and control lines.

The display panel 210 includes a first dummy area DA1 arranged to the left of an active area AA and a second dummy area DA2 arranged to the right of the active area AA. A first dummy data line DDL1 and a plurality of first dummy pixels (e.g., DPa) coupled to the first dummy data line DDL1 are arranged in the first dummy area DA1. A second dummy data line DDL2 and a plurality of second dummy pixels (e.g., DPb) coupled to the second dummy data line DDL2 are arranged in the second dummy area DA2. The first dummy area DA1 and the second dummy area DA2 correspond to the dummy area DA of FIG. 1.

The active area AA is divided into a first active area AA1 and a second active area AA2. A first connection line GL1 coupled to the first dummy data line DDL1 is arranged at the top of the first active area AA1, and a second connection line GL2 coupled to the second dummy data line DDL2 is arranged at the top of the second active area AA2. The first connection line GL1 and the second connection line GL2 are insulated from each other. The first connection line GL1 and the second connection line GL2 may be arranged at the bottoms of the first active area AA1 and the second active area AA2, respectively. Data lines DLa in the first active area AA1 are arranged connectably to the first connection line GL1. Data lines DLb in the second active area AA2 are arranged connectably to the second connection line GL2.

The display panel 210 includes first repair lines (e.g., RLa) extending from the plurality of first dummy pixels DPa in the first dummy area DA1 to the first active area AA1 and second repair lines (e.g., RLb) extending from the plurality of second dummy pixels DPb in the second dummy area DA2 to the second active area AA2. The first repair lines RLa and the second repair lines RLb are insulated from one other.

At least one defective pixel BPa in the first active area AA1 may be repaired using the first repair lines RLa, the first connection line GL1, and the first dummy data line DDL1. A plurality of defective pixels BPa located in the same column may be repaired even without an additional connection line and an additional dummy data line. A light-emitting device E of a defective pixel BPa in the first active area AA1 is separated from a pixel circuit C thereof and is coupled to a dummy circuit DC of a first dummy pixel DPa in the same row as the defective pixel BPa via a first repair line RLa. A data line DLa coupled to the defective pixel BPa is coupled to the first connection line GL1, and a data signal applied to the data line DLa is also applied to the dummy circuit DC. The dummy circuit DC generates a driving current corresponding to the data signal and provides the driving current to the light-emitting device E of the defective pixel BPa via the first repair line RLa, and the light-emitting device E emits light in response to the driving current.

At least one defective pixel BPb in the second active area AA2 may be repaired using the second repair lines RLb, the second connection line GL2, and the second dummy data line DDL2. A light-emitting device E of a defective pixel BPb in the second active area AA2 is separated from a pixel circuit C thereof and is coupled to a dummy circuit DC of a second dummy pixel DPb in the same row as the defective pixel BPb via a second repair line RLb. A data line DLb coupled to the defective pixel BPb is coupled to the second connection line GL2, and a data signal applied to the data line DLb is also applied to the dummy circuit DC. The dummy circuit DC generates a driving current corresponding to the data signal and provides the driving current to the light-emitting device E of the defective pixel BPb via the second repair line RLb, and the light-emitting device E emits light in response to the driving current.

According to the present embodiment, at least one defective pixel BPa in the first active area AA1 and at least one defective pixel BPb in the second active area AA2 may be repaired. Furthermore, according to the present embodiment, two defective pixels in a same row may be repaired.

In the embodiments described above, a repair process has been described as an example of coupling a defective pixel and a dummy pixel in a same row via a repair line in the same row. However, the embodiments are not limited thereto and a defective pixel may be coupled to a dummy pixel located in another row via a repair line located in the same row as the defective pixel.

Figure 5:
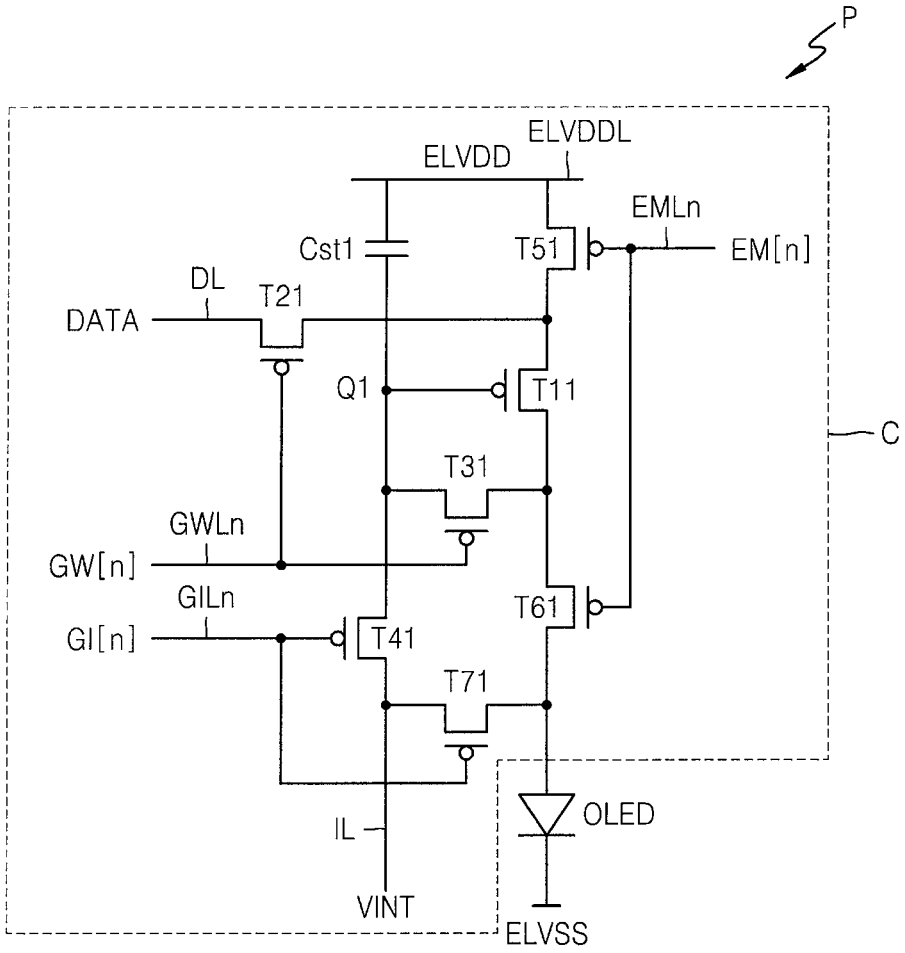
FIG. 5 is a circuit diagram of a pixel according to an embodiment of the present invention.

FIG. 5 is a circuit diagram of a pixel P according to an embodiment of the present invention.

The pixel P shown in FIG. 5 is one of a plurality of pixels P included in an nth row and is coupled to a scan line GWLn, an initialization control line GILn, and an emission control line EMLn which correspond to the nth row, thereby receiving an nth scan signal GW[n], an nth initialization control signal GI[n], and an nth emission control signal EM[n], respectively.z The pixel P includes a pixel circuit C and an organic light-emitting diode OLED that is coupled to the pixel circuit C and emits light as a light-emitting device E. The organic light-emitting diode OLED may include a pixel electrode (e.g., an anode), an opposite electrode (e.g., a cathode), and an emission layer between the anode and the cathode.

The pixel circuit C includes a driving transistor T11, a switching transistor T21, a compensation transistor T31, an initialization transistor T41, a first emission control transistor T51, a second emission control transistor T61, a bypass transistor T71, and a capacitor Cst1.

A gate electrode of the driving transistor T11 is coupled to a first node Q1, a first electrode thereof is coupled to a driving voltage line ELVDDL via the first emission control transistor T51, and a second electrode thereof is electrically coupled to the anode of the organic light-emitting diode OLED via the second emission control transistor T61. A current (e.g., a driving current) flowing through the organic light-emitting diode OLED is determined by a voltage difference between the gate electrode and the second electrode of the driving transistor T11.

A gate electrode of the switching transistor T21 is coupled to the scan line GWLn, a first electrode thereof is coupled to a data line DL, and a second electrode thereof is coupled to the first electrode of the driving transistor T11. The switching transistor T21 is turned on according to the nth scan signal GW[n] received through the scan line GWLn, thereby delivering a data signal DATA received through the data line DL to the first electrode of the driving transistor T11, and the data signal DATA is delivered to the gate electrode of the driving transistor T11 by the compensation transistor T31 which is concurrently (e.g., simultaneously) turned on.

A gate electrode of the compensation transistor T31 is coupled to the scan line GWLn, a first electrode thereof is coupled to the second electrode of the driving transistor T11, and a second electrode thereof is coupled to the first node Q1. The compensation transistor T31 is turned on according to the nth scan signal GW[n] received through the scan line GWLn and couples the gate electrode and the second electrode of the driving transistor T11 to each other, thereby diode-connecting the driving transistor T11 and compensating for a threshold voltage Vth of the driving transistor T11.

A gate electrode of the initialization transistor T41 is coupled to the initialization control line GILn, a first electrode thereof is coupled to an initialization voltage line IL, and a second electrode thereof is coupled to the first node Q1. The initialization transistor T41 is turned on according to the nth initialization control signal GI[n] applied through the initialization control line GILn and delivers an initialization voltage VINT to the first node Q1, thereby initializing the first node Q1. The initialization voltage VINT may be set to a voltage that is higher than or equal to a second power source voltage ELVSS.

A gate electrode of the first emission control transistor T51 is coupled to the emission control line EMLn, a first electrode thereof is coupled to the driving voltage line ELVDDL, and a second electrode thereof is coupled to the first electrode of the driving transistor T11.

A gate electrode of the second emission control transistor T61 is coupled to the emission control line EMLn, a first electrode thereof is coupled to the second electrode of the driving transistor T11, and a second electrode thereof is electrically coupled to the anode of the organic light-emitting diode OLED. The first emission control transistor T51 and the second emission control transistor T61 are concurrently (e.g., simultaneously) turned on according to the nth emission control signal EM[n] applied through the emission control line EMLn and applies a first power source voltage ELVDD to the driving transistor T11, thereby making the driving current flow through the organic light-emitting diode OLED.

A gate electrode of the bypass transistor T71 is coupled to the initialization control line GILn, a first electrode thereof is coupled to the anode of the organic light-emitting diode OLED, and a second electrode thereof is coupled to the initialization voltage line IL. The bypass transistor T71 is turned on according to the nth initialization control signal GI[n] applied through the initialization control line GILn, thereby initializing the anode of the organic light-emitting diode OLED.

The capacitor Cst1 is coupled between the driving voltage line ELVDDL and the first node Q1. The capacitor Cst1 stores a voltage between the first power source voltage ELVDD and a voltage at the first node Q1.

The anode of the organic light-emitting diode OLED is connectable to a repair line RLn and is separable from the pixel circuit C. The cathode of the organic light-emitting diode OLED is coupled to a second power source which applies a second power source voltage ELVSS. The organic light-emitting diode OLED emits light in response to the driving current received from the driving transistor T11, thereby displaying an image. The first power source voltage ELVDD may be a certain high-level voltage, and the second power source voltage ELVSS may be lower than the first power source voltage ELVDD or a ground voltage.

An operation of the pixel P will bow be described.

During an initialization period, the nth initialization control signal GI[n] of a low level is supplied through the initialization control line GILn, thereby turning on the initialization transistor T41 and the bypass transistor T71. The initialization voltage VINT applied through the initialization voltage line IL is delivered to the gate electrode of the driving transistor T11 via the initialization transistor T41 and delivered to the anode via the bypass transistor T71. Accordingly, voltages of the gate electrode of the driving transistor T11 and the anode are initialized.

Thereafter, during a data write period, the nth scan signal GW[n] of a low level is supplied through the scan line GWLn, thereby turning on the switching transistor T21 and the compensation transistor T31. The switching transistor T21 delivers the data signal DATA received through the data line DL to the first electrode of the driving transistor T11, and the driving transistor T11 is diode-coupled by the compensation transistor T31. Accordingly, a compensation voltage (DATA+Vth, Vth, where Vth has a negative value) obtained by subtracting the threshold voltage Vth from the data signal DATA is applied to the gate electrode of the driving transistor T11.

The first power source voltage ELVDD and the compensation voltage (DATA+Vth) are respectively applied to both ends of the capacitor Cst1, and charges corresponding to a voltage difference between the both ends of the capacitor Cst1 are stored in the capacitor Cst1.

Thereafter, during an emission period, the nth emission control signal EM[n] supplied through the emission control line EMLn is changed from a high level to a low level, thereby turning on the first emission control transistor T51 and the second emission control transistor T61. Accordingly, the driving current due to a voltage difference between the voltage of the gate electrode of the driving transistor T11 and the first power source voltage ELVDD is generated and is supplied to the organic light-emitting diode OLED via the second emission control transistor T61, thereby making the organic light-emitting diode OLED emit light.

Figure 6:
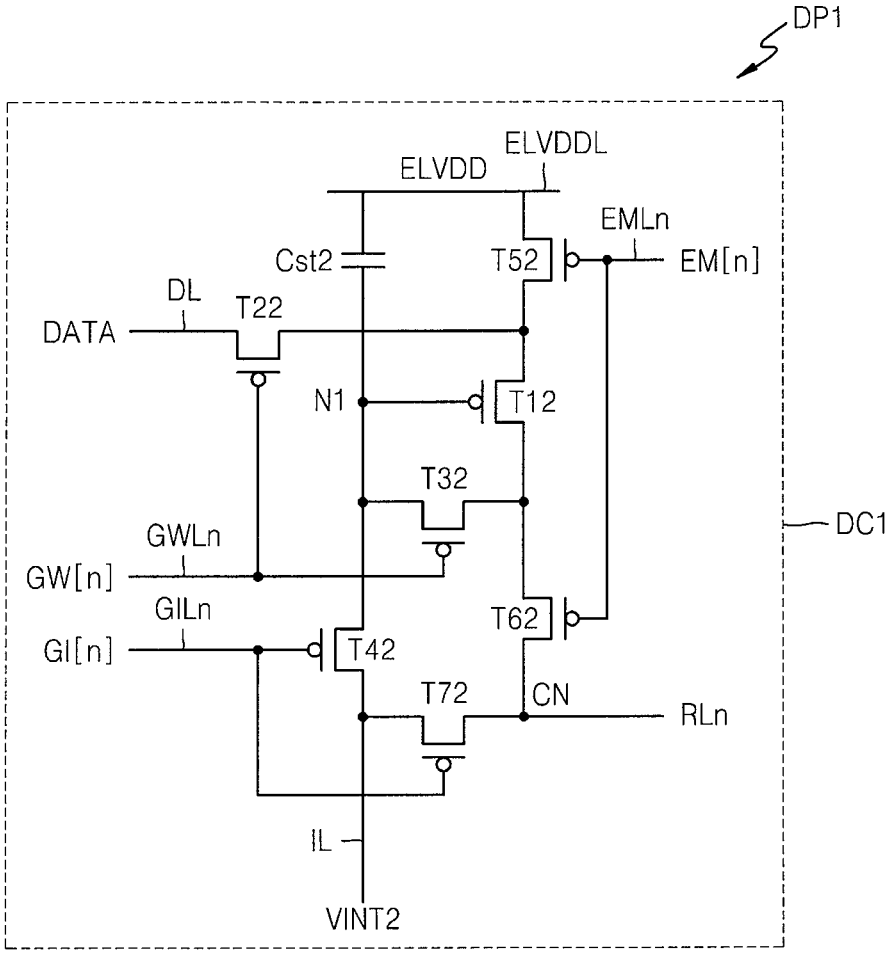
FIG. 6 is a circuit diagram of a dummy pixel according to an embodiment of the present invention.

FIG. 6 is a circuit diagram of a dummy pixel DP1 according to an embodiment of the present invention.

The dummy pixel DP1 shown in FIG. 6 is located in an nth row or (n+1)th row. The dummy pixel DP1 is coupled to the scan line GWLn, the initialization control line GILn, and the emission control line EMLn, which correspond to the nth row, thereby receiving the nth scan signal GW[n], the nth initialization control signal GI[n], and the nth emission control signal EM[n], respectively.

The dummy pixel DP1 includes a dummy circuit DC1. The dummy circuit DC1 includes a driving transistor T12, a switching transistor T22, a compensation transistor T32, an initialization transistor T42, a first emission control transistor T52, a second emission control transistor T62, a bypass transistor T72, and a capacitor Cst2. The components in the dummy circuit DC1 may have different sizes and capacities from the components in a pixel circuit C.

The dummy circuit DC1 in the dummy pixel DP1 is almost the same as the pixel circuit C in the pixel P shown in FIG. 5 except for some partial differences. These differences will now be primarily described below.

The dummy pixel DP1 does not include a light-emitting device. However, the dummy pixel DP1 may include a light-emitting device according to a design. When the dummy pixel DP1 includes a light-emitting device, the light-emitting device may not actually emit light and may function as a circuit device. For example, the light-emitting device may function as a capacitor.

A gate electrode of the driving transistor T12 is coupled to a first node N1, and a second electrode of the second emission control transistor T62 and a first electrode of the bypass transistor T72 are coupled to a connection node CN coupled to a repair line RLn. A first electrode of the initialization transistor T42 and a second electrode of the bypass transistor T72 are coupled to the initialization voltage line IL, and the initialization voltage line IL applies a second initialization voltage VINT2. The second initialization voltage VINT2 may be lower than the initialization voltage VINT.

When the dummy pixel DP1 shown in FIG. 6 is coupled to an organic light-emitting diode in a defective pixel via the repair line RLn, an operation of the dummy pixel DP1 is the same as the operation of pixel P shown in FIG. 5.

Figure 7A:
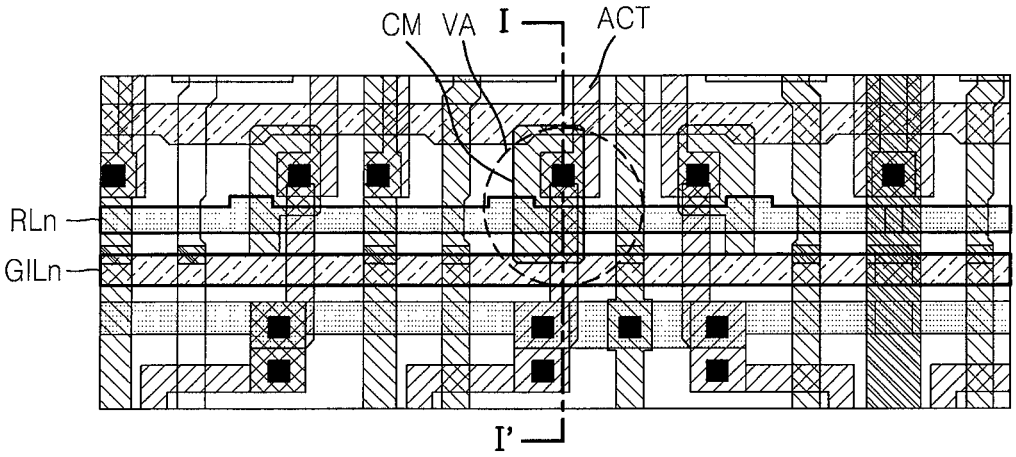
FIGS. 7A and 7B illustrate a portion of a display panel according to an embodiment of the present invention.
Figure 7B:
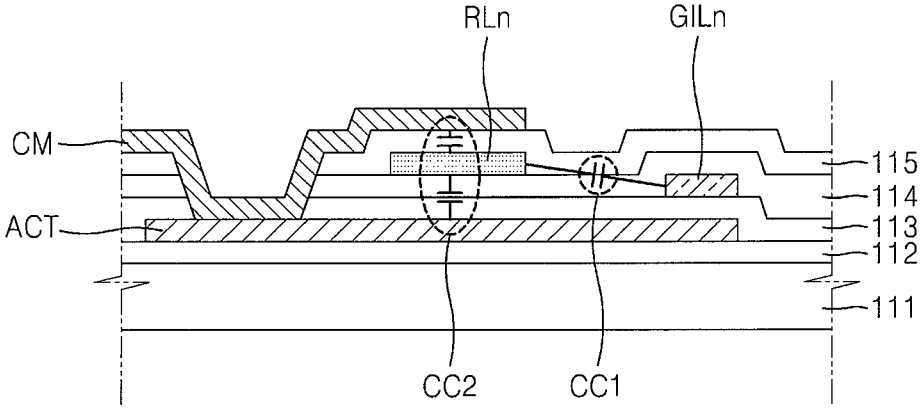
Figure 8:
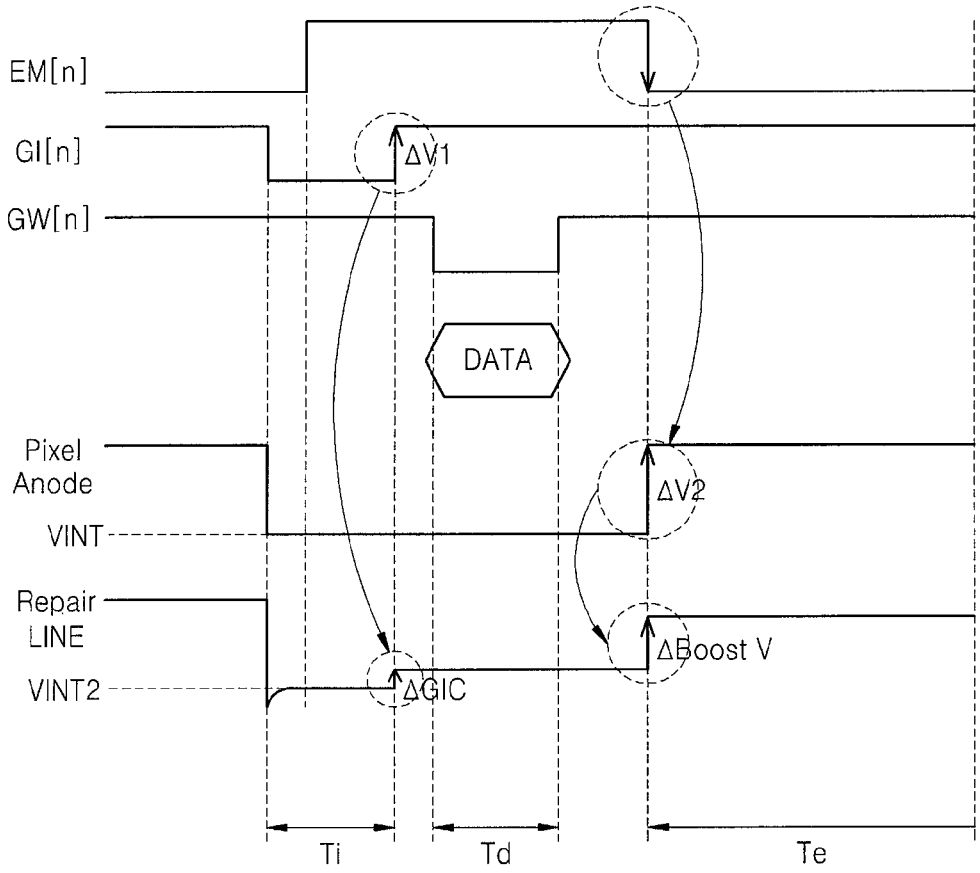
FIG. 8 is a timing diagram for describing coupling of a repair line.

FIGS. 7A and 7B illustrate a portion of a display panel according to an embodiment of the present invention, wherein FIG. 7A illustrates a portion of a plurality of pixels P arranged in an nth row, and FIG. 7B is a cross-sectional view of a via hole region VA taken along the line I-I' of FIG. 7A. FIG. 8 is a timing diagram for describing coupling of a repair line RLn.

Referring to FIGS. 7A and 7B, a buffer layer 112 is selectively formed on a substrate 111, and an active layer ACT formed of polysilicon is formed on the buffer layer 112. A first insulating layer 113 is formed on the active layer ACT, and an initialization control line GILn is formed on the first insulating layer 113. A second insulating layer 114 is formed on the initialization control line GILn, the repair line RLn is formed on the second insulating layer 114. A third insulating layer 115 is formed on the repair line RLn, and a contact metal CM is formed on the third insulating layer 115 so as to contact the active layer ACT exposed through a hole that penetrates through the first to third insulating layers 113 to 115. An anode may be formed on the contact metal CM in contact with the contact metal CM.

With respect to the repair line RLn, a first coupling capacitor CC1 may be formed between the repair line RLn and the initialization control line GILn arranged in parallel to the repair line RLn, and a second coupling capacitor CC2 may be formed between the repair line RLn and the active layer ACT and between the repair line RLn and the contact metal CM, in the via hole region VA of a pixel P. Since the active layer ACT and the contact metal CM in the via hole region VA contact an anode, the second coupling capacitor CC2 may be considered as being a coupling capacitor formed between the anode and the repair line RLn.

A defective pixel (hereinafter, referred to as "a repair pixel") coupled to a dummy pixel DP1 via the repair line RLn receives a driving current from the dummy pixel DP1 via the repair line RLn.

Hereinafter, an operation will be described when the pixel P shown in FIG. 5 is a repair pixel, and the light-emitting device E of the repair pixel P is coupled to the dummy pixel DP1 shown in FIG. 6 via the repair line RLn.

Referring to FIG. 8, during an initialization period Ti, the nth initialization control signal GI[n] is applied at a low level VGL through the initialization control line GILn in an nth row, thereby initializing voltages of anodes of a plurality of pixels P arranged in the nth row to the initialization voltage VINT and initializing a voltage of the repair line RLn coupled to an anode of the repair pixel P to the second initialization voltage VINT2.

Thereafter, when a voltage of the nth initialization control signal GI[n] is changed (ΔV1=VGH−VGL) according to the nth initialization control signal GI[n] transitioning from the low level VGL to a high level VGH, the voltage of the repair line RLn increase by a first coupling voltage LGIC and becomes "VINT2+ΔGIC" due to the first coupling capacitor CC1 formed between the repair line RLn and the initialization control line GILn. The first coupling voltage ΔGIC is "(VGH−VGL)×(CC1/Ctotal)", wherein Ctotal denotes a total capacitor formed on the repair line RLn.

In a data write period Td, the nth scan signal GW[n] is applied at a low level through the scan line GWLn in the nth row, thereby applying the data signal DATA to each pixel P and the dummy pixel DP1.

Thereafter, during an emission period Te, the nth emission control signal EM[n] is applied at a low level through the emission control line EMLn, thereby changing voltages of the anodes of the plurality of pixels P arranged in the nth row by ΔV2 in response to the data signal DATA. The anode voltage change amount ΔV2 is "Voledon−(VINT−ELVSS)", wherein Voledon denotes an anode voltage (i.e., a voltage when an organic light-emitting diode OLED emits light). At this time, the voltage of the repair line RLn increases by a second coupling voltage ΔBoostV and becomes "VINT2+ΔGIC+ΔBoostV" by the second coupling capacitor CC2 formed between the repair line RLn and the anodes of the plurality of pixels P, wherein the second coupling voltage ΔBoostV is "ΔV2×(CC2/Ctotal)".

When a coupling capacitor of the repair line RLn has a large capacitance, a coupling voltage (ΔGIC+ΔBoostV) of the repair line RLn is large, and accordingly, when a potential of the repair line RLn is greater than or equal to a potential of a threshold voltage OLEDvth of an organic light-emitting diode OLED, when a data signal of a black brightness is applied to the repair pixel P, the repair pixel P may incorrectly emit light, thereby exhibiting a brightness that is higher than the black brightness.

Figure 9:
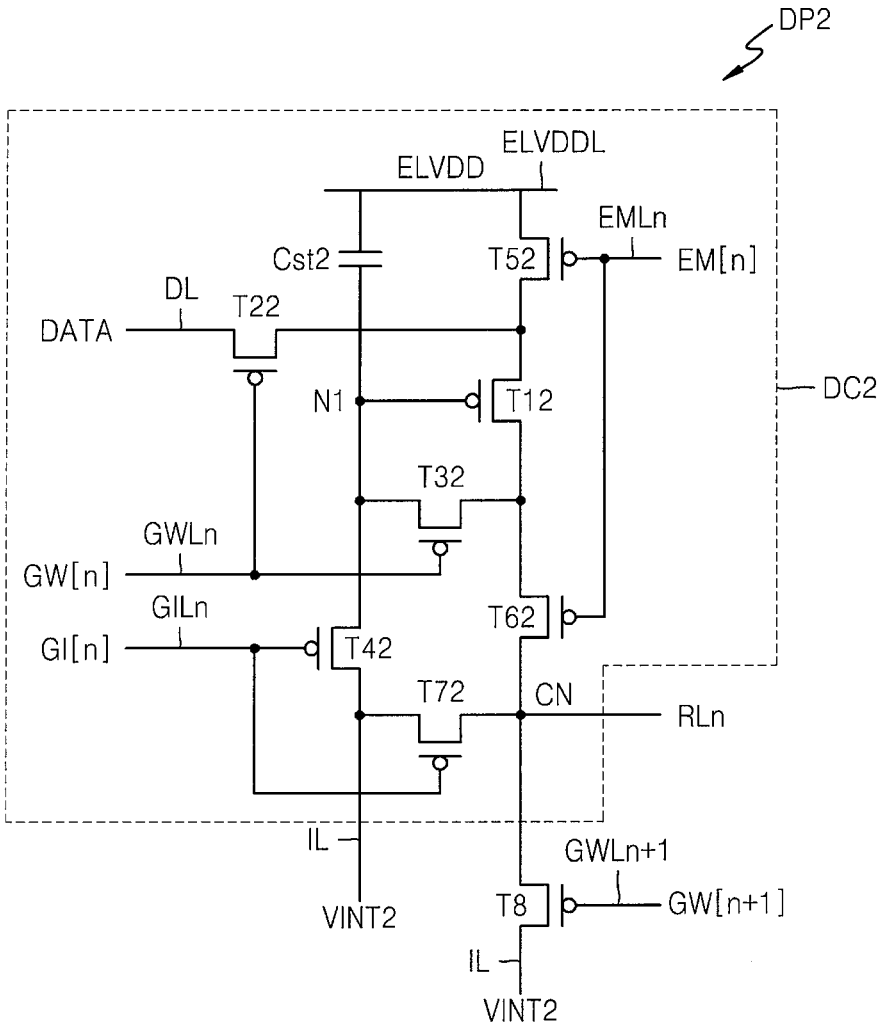
FIG. 9 is a circuit diagram of a dummy pixel according to another embodiment of the present invention.

FIG. 9 is a circuit diagram of a dummy pixel DP2 according to another embodiment of the present invention. FIGS. 10A, 10B, 11A, 11B, and 11C are timing diagrams for describing an operation of removing coupling by using the dummy pixel DP2 shown in FIG. 9.

The dummy pixel DP2 shown in FIG. 9 differs from the dummy pixel DP1 shown in FIG. 6 in that a coupling removal transistor T8 is further included, and has the same configuration as the dummy pixel DP1 shown in FIG. 6 except for the coupling removal transistor T8. The difference will now be primarily described.

Referring to FIG. 9, the dummy pixel DP2 is located in an nth or (n+1)th row. The dummy pixel DP2 is coupled to the scan line GWLn corresponding to the nth row and a scan line GWLn+1, an initialization control line GILn, and an emission control line EMLn which correspond to the nth row, thereby receiving nth and (n+1)th scan signals GW[n] and GW[n+1], an (nth initialization control signal GI[n], and an nth emission control signal EM[n], respectively.

The dummy pixel DP2 includes a dummy circuit DC2 and a coupling removal device coupled to the dummy circuit DC2. The dummy circuit DC2 includes the driving transistor T12, the switching transistor T22, the compensation transistor T32, the initialization transistor T42, the first emission control transistor T52, the second emission control transistor T62, the bypass transistor T72, and the capacitor Cst2. The coupling removal device includes the coupling removal transistor T8.

A gate electrode of the coupling removal transistor T8 in the dummy pixel DP2 is coupled to a coupling control line, a first electrode thereof is coupled to the connection node CN (or the repair line RLn), and a second electrode thereof is coupled to the initialization voltage line IL.

A coupling control signal by which the coupling removal transistor T8 is turned on may be applied in correspondence with a level change time point of a control signal applied to first pixels P, which are arranged along the repair line RLn from among a plurality of pixels P, through at least one control line arranged in parallel to the repair line RLn or with an emission time point of the first pixels P.

Figure 10A:
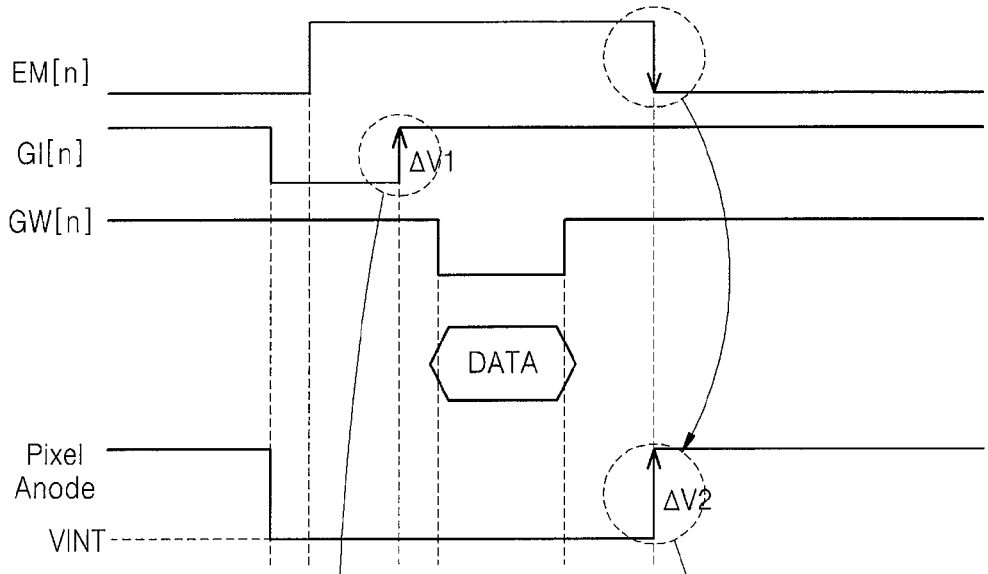
FIGS. 10A, 10B, 11A, 11B, and 11C are timing diagrams for describing an operation of removing coupling by using the dummy pixel shown in FIG. 9.
Figure 10B:
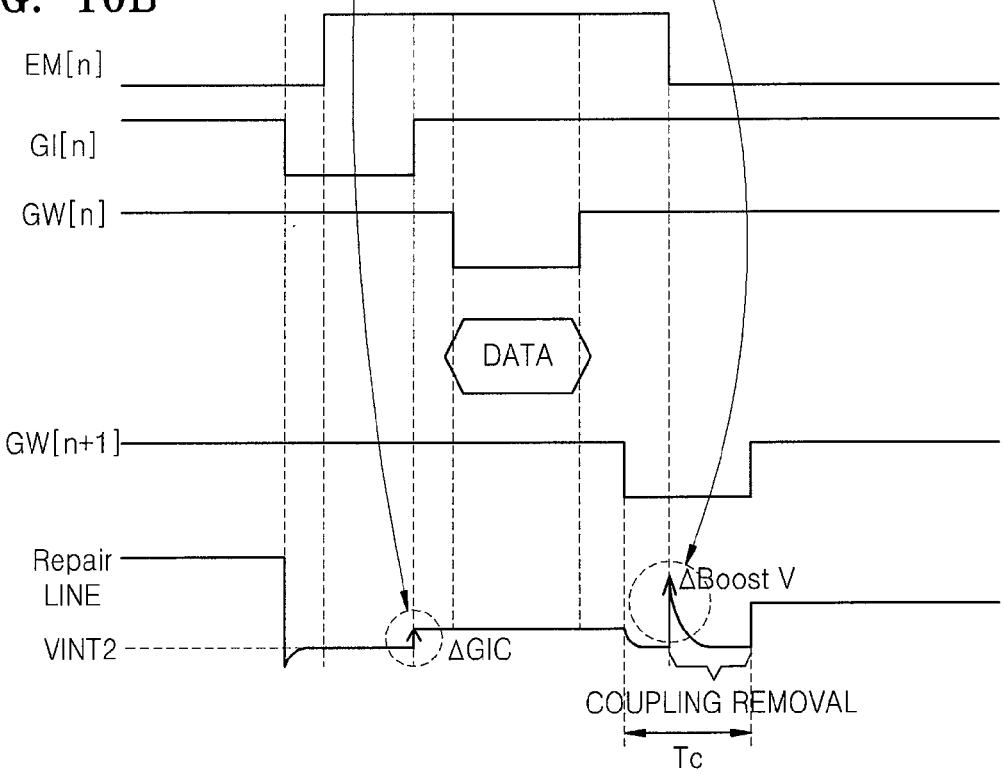

For example, the coupling control line may be the scan line GWLn corresponding to the nth row, and the coupling control signal may be the nth scan signal GW[n]. Alternatively, the coupling control line may be the scan line GWLn+1 corresponding to the (n+1)th row, and the coupling control signal may be the (n+1)th scan signal GW[n+1] lagging by a certain unit time from the nth scan signal GW[n]. Alternatively, the coupling control line may be a scan line GWLn+2 corresponding to an (n+2)th row, and the coupling control signal may be an (n+2)th scan signal GW[n+2] lagging by certain two unit times (e.g., delayed by two units of time) from the nth scan signal GW[n]. In the embodiment of FIGS. 10A and 10B, the coupling control line is the scan line GWLn+1 corresponding to the (n+1)th row, and the coupling control signal is the (n+1)th scan signal GW[n+1].

Hereinafter, an operation will be described assuming that the pixel P shown in FIG. 5 is a repair pixel, and the light-emitting device E of the repair pixel P is coupled to the dummy pixel DP2 shown in FIG. 9 via the repair line RLn.

FIG. 10A is an operation timing diagram of a pixel P, and FIG. 10B is an operation timing diagram of the dummy pixel DP2. Referring to FIGS. 10A and 10B, the pixel P and the dummy pixel DP2 have the same initialization period, data write period, and emission period.

During the initialization period, the nth initialization control signal GI[n] is applied at the low level VGL through the initialization control line GILn in the nth row, thereby initializing voltages of anodes of a plurality of pixels P arranged in the nth row to the initialization voltage VINT and initializing a voltage of the repair line RLn coupled to an anode of the repair pixel P to the second initialization voltage VINT2.

Thereafter, when a voltage of the nth initialization control signal GI[n] is changed by ΔV1 according to the nth initialization control signal GI[n] transitioning from the low level VGL to the high level VGH, the voltage of the repair line RLn increase by ΔGIC and becomes "VINT2+ΔGIC" by the first coupling capacitor CC1 formed between the repair line RLn and the initialization control line GILn.

During the data write period, the nth scan signal GW[n] is applied at a low level through the scan line GWLn in the nth row, thereby applying the data signal DATA to each pixel P and the dummy pixel DP2. The data signal DATA applied to the dummy pixel DP2 is the data signal DATA to be applied to the repair pixel P.

Thereafter, during the emission period, the nth emission control signal EM[n] is applied at a low level through the emission control line EMLn, thereby changing voltages of the anodes of the plurality of pixels P arranged in the nth row by ΔV2 in response to the data signal DATA. The voltage of the repair line RLn increases by ΔBoostV and becomes "VINT2+ΔGIC+ΔBoostV" by the second coupling capacitor CC2 formed between the repair line RLn and the anodes of the plurality of pixels P.

However, during a coupling removal period Tc, the (n+1) th scan signal GW[n+1] is applied through the (n+1)th scan line GWLn+1 to the gate electrode of the coupling removal transistor T8 in the dummy pixel DP2, thereby removing a coupling voltage "ΔGIC+ΔBoostV" of the repair line RLn. Accordingly, the repair line RLn returns to the second initialization voltage VINT2. Therefore, when the data signal DATA applied to the dummy pixel DP2 is a black image signal, the repair pixel P may accurately emit light corresponding to a black brightness.

An occurrence (or a location) of the coupling removal period Tc may be controlled by controlling a timing of applying the coupling control signal to the coupling removal transistor T8.

In the embodiment of FIGS. 10A and 10B, the coupling removal period Tc includes an emission period starting time point of the pixel P by using the (n+1)th scan signal GW[n+1] as the coupling control signal. In this case, during the coupling removal period Tc, voltage increase amounts of the repair line RLn that occur two times (e.g., the voltage of the repair line RLn increases twice) due to the first coupling capacitor CC1 and the second coupling capacitor CC2 may be removed.

Figure 11A:
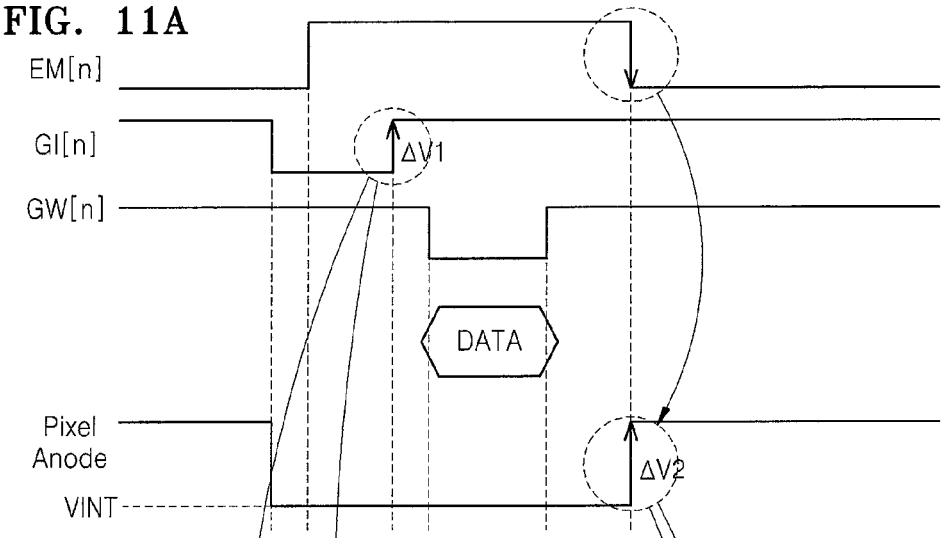
Figure 11B:
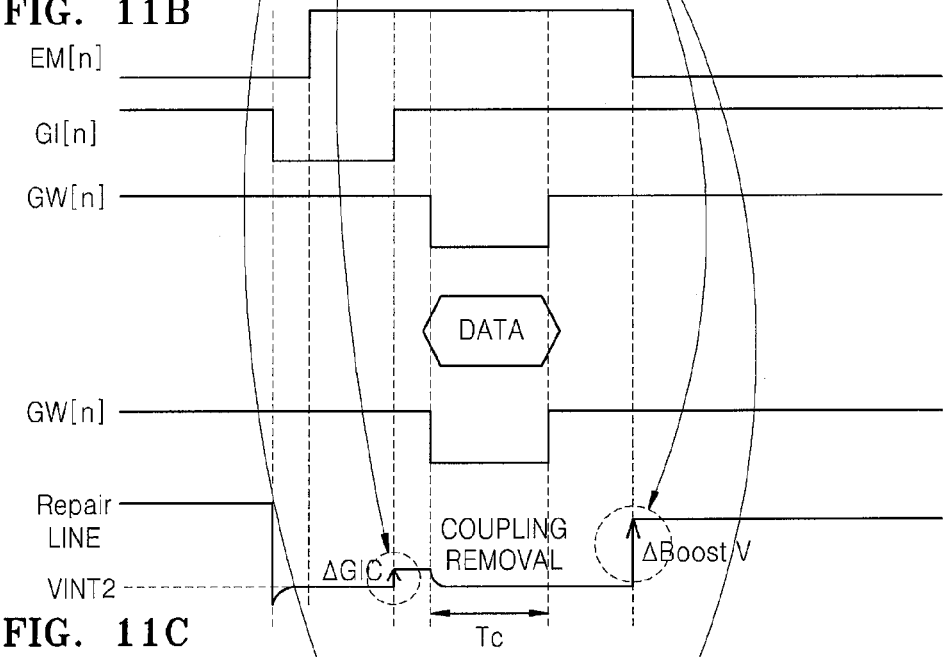

In another example, as shown in FIG. 11B, the coupling removal period Tc may occur during the data write period of the pixel P by using the nth scan signal GW[n] as the coupling control signal. In this case, during the coupling removal period Tc, only the coupling voltage of the repair line RLn due to the first coupling capacitor CC1 formed between the repair line RLn and the initialization control line GILn is removed.

Figure 11C:
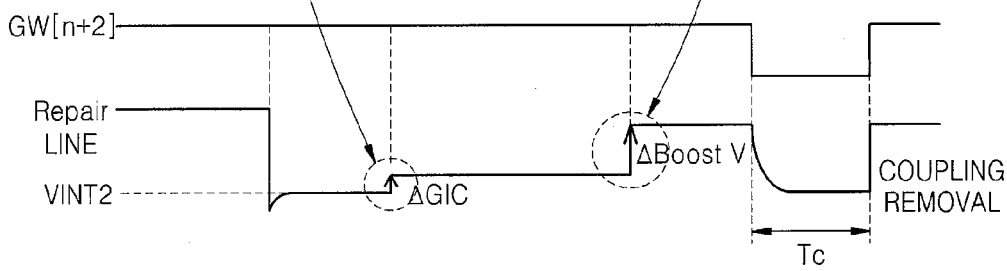

In another example, as shown in FIG. 11C, the coupling removal period Te may occur during the emission period of the pixel P by using the (n+2)th scan signal GW[n+2] as the coupling control signal. In this case, during the coupling removal period Tc, both the coupling voltages of the repair line RLn due to the first coupling capacitor CC1 and the second coupling capacitor CC2 may be removed.

Figure 12:
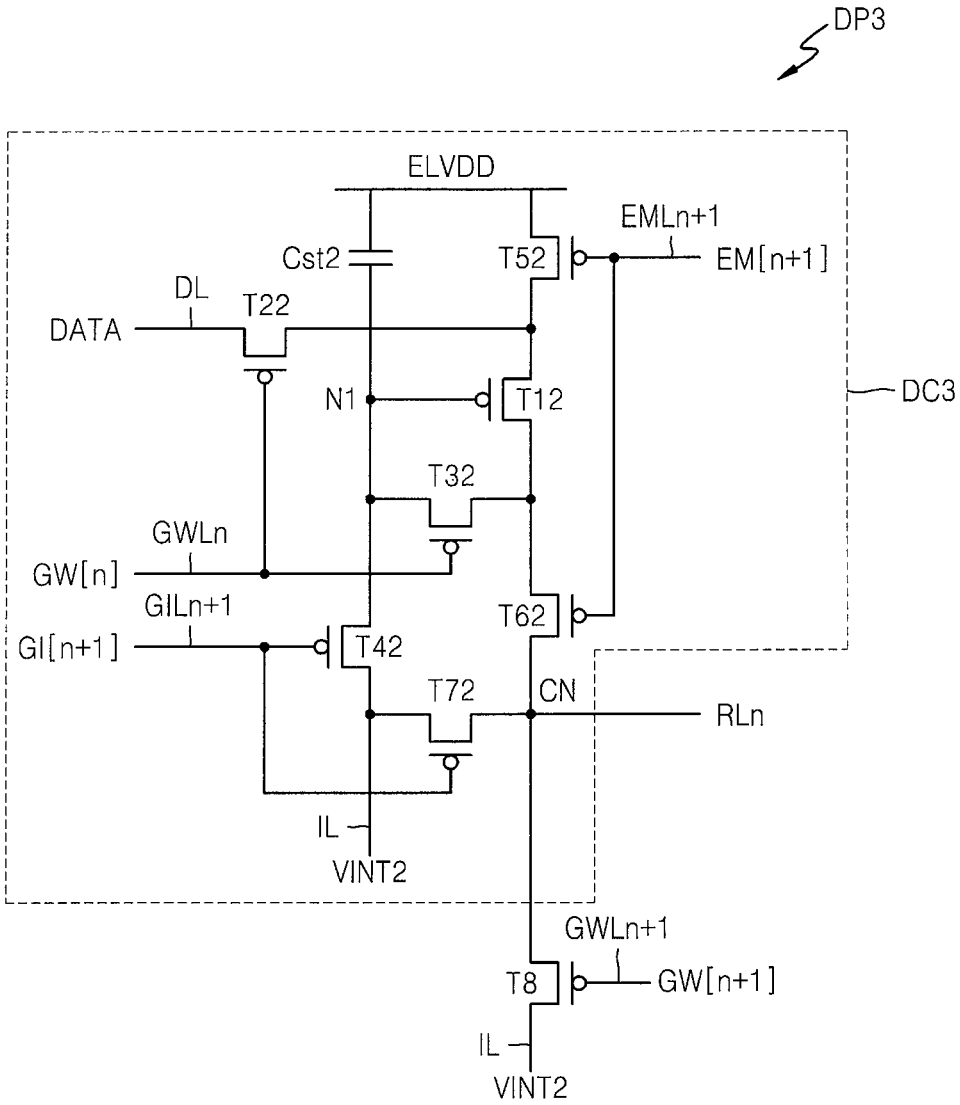
FIG. 12 is a circuit diagram of a dummy pixel according to another embodiment of the present invention.
Figure 13A:
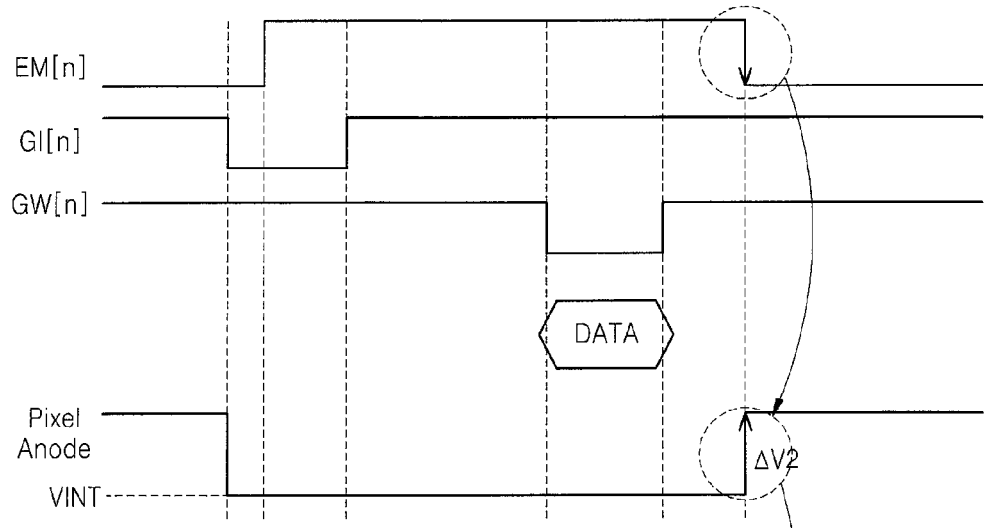
FIGS. 13A and 13B are timing diagrams for describing an operation of removing coupling by using the dummy pixel shown in FIG. 12.
Figure 13B:
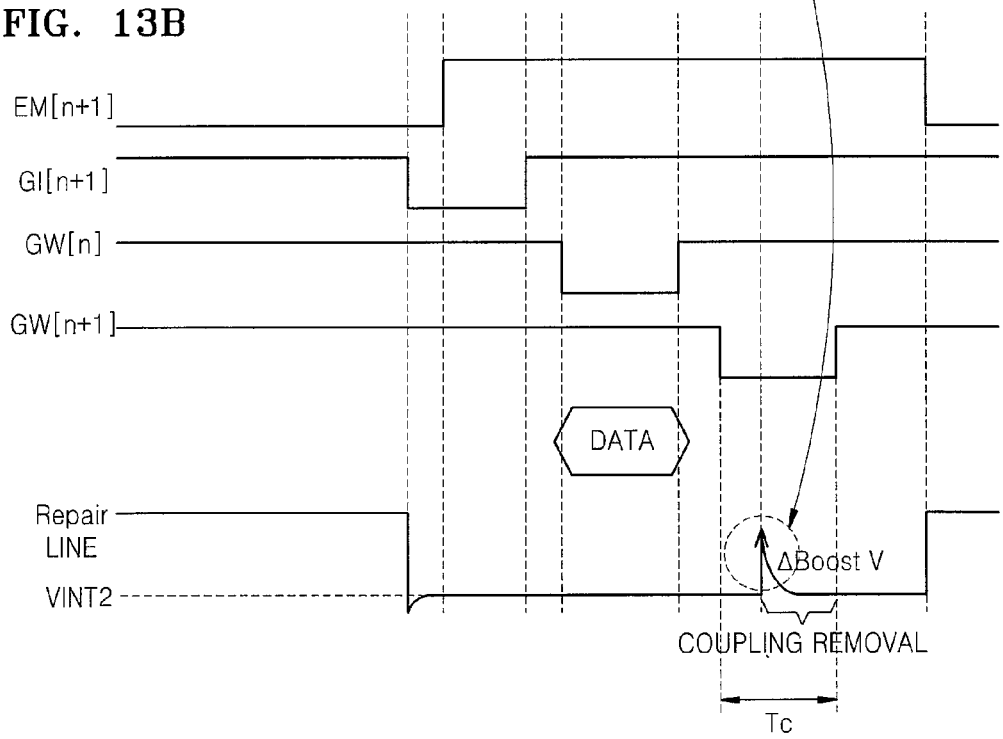

FIG. 12 is a circuit diagram of a dummy pixel DP3 according to another embodiment of the present invention. FIGS. 13A and 13B are timing diagrams for describing an operation of removing coupling by using the dummy pixel DP3 shown in FIG. 12.

The dummy pixel DP3 shown in FIG. 12 is almost the same as the dummy pixel DP2 shown in FIG. 9 except for some partial differences. These differences will now be primarily described.

Referring to FIG. 12, the dummy pixel DP3 includes a dummy circuit DC3 and a coupling removal device coupled to the dummy circuit DC3. The dummy circuit DC3 includes the driving transistor T12, the switching transistor T22, the compensation transistor T32, the initialization transistor T42, the first emission control transistor T52, the second emission control transistor T62, the bypass transistor T72, and the capacitor Cst2. The coupling removal device includes the coupling removal transistor T8.

The gate electrode of the coupling removal transistor T8 is coupled to a coupling control line, the first electrode thereof is coupled to the connection node CN, and the second electrode thereof is coupled to the initialization voltage line IL. In the embodiment shown in FIG. 12, the coupling control line is the scan line GWLn+1 corresponding to the (n+1)th row, and a coupling control signal is the (n+1)th scan signal GW[n+1]. In another example, the coupling control line may be the scan line GWLn corresponding to the nth row, and the coupling control signal may be the nth scan signal GW[n]. In another example, the coupling control line may be the scan line GWLn+2 corresponding to the (n+2)th row, and the coupling control signal may be the (n+2)th scan signal GW[n+2].

Hereinafter, an operation will be described assuming that the pixel P shown in FIG. 5 is a repair pixel, and the light-emitting device E of the repair pixel P is coupled to the dummy pixel DP3 shown in FIG. 12 via the repair line RLn.

FIG. 13A is an operation timing diagram of a pixel P, and FIG. 13B is an operation timing diagram of the dummy pixel DP3. Referring to FIGS. 13A and 13B, the pixel P and the dummy pixel DP3 have the same data write period, but an initialization period and an emission period of the dummy pixel DP3 lag behind those of the pixel P by a set time (e.g., a predetermined time).

During the initialization period of the pixel P, the nth initialization control signal GI[n] is applied at a low level through the initialization control line GILn in the nth row, thereby initializing voltages of anodes of a plurality of pixels P arranged in the nth row to the initialization voltage VINT. During the initialization period of the repair pixel P, the (n+1)th initialization control signal GI[n+1] is applied at a low level through the initialization control line GILn+1 in the (n+1)th row, thereby initializing a voltage of the repair line RLn coupled to an anode of the repair pixel P to the second initialization voltage VINT2.

Thereafter, during the data write period, the nth scan signal GW[n] of the low level is applied to each pixel P and the dummy pixel DP3 through the scan line GWLn corresponding to the nth row, thereby applying the data signal DATA to each pixel P and the dummy pixel DP3. The data signal DATA applied to the dummy pixel DP3 is the data signal DATA to be applied to the repair pixel P.

Thereafter, during the emission period of the pixel P, the nth emission control signal EM[n] is applied at a low level through the emission control line EMLn, thereby changing voltages of the anodes of the plurality of pixels P arranged in the nth row by ΔV2 in response to the data signal DATA. The voltage of the repair line RLn increases by ΔBoostV and becomes "VINT2+ΔBoostV" by the second coupling capacitor CC2 formed between the repair line RLn and the anodes of the plurality of pixels P.

However, during the coupling removal period Tc, the (n+1)th scan signal GW[n+1] is applied through the (n+1)th scan line GWLn+1 to the gate electrode of the coupling removal transistor T8 in the dummy pixel DP3, thereby removing a coupling voltage ΔBoostV of the repair line RLn. Accordingly, the repair line RLn returns to the second initialization voltage VINT2. Therefore, when the data signal DATA applied to the dummy pixel DP3 is a black image signal, the repair pixel P may accurately emit light corresponding to a black brightness.

Figure 14:
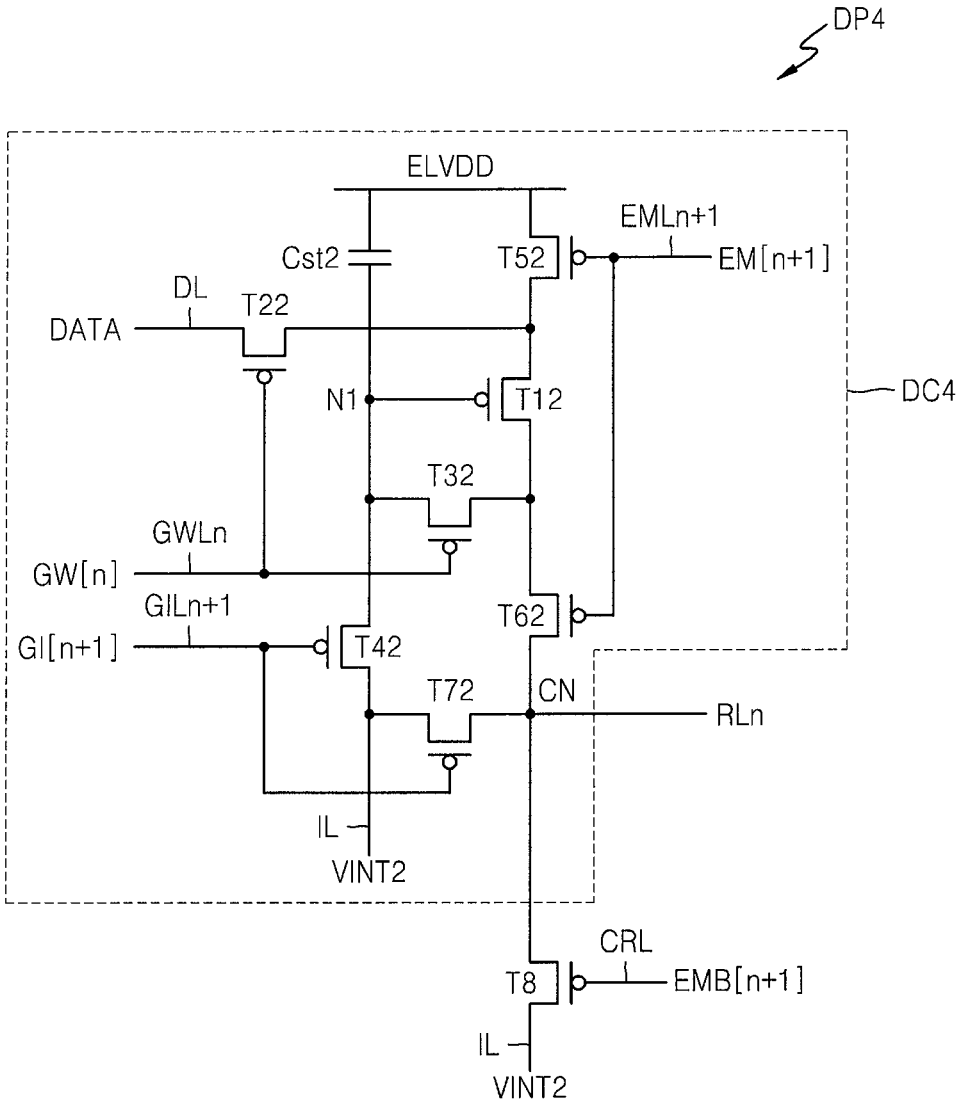
FIG. 14 is a circuit diagram of a dummy pixel according to another embodiment of the present invention.
Figure 15A:
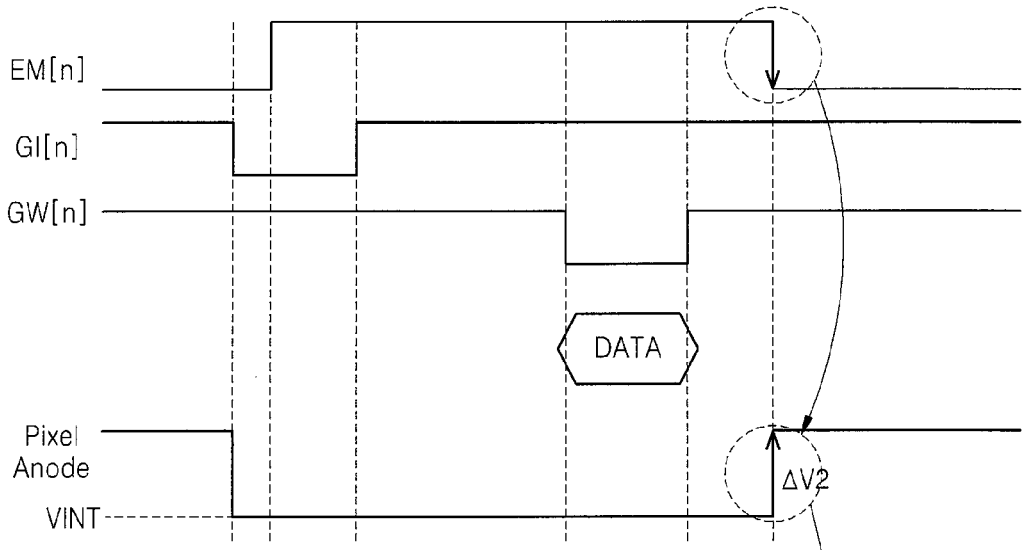
FIGS. 15A and 15B are timing diagrams for describing an operation of removing coupling by using the dummy pixel shown in FIG. 14.
Figure 15B:
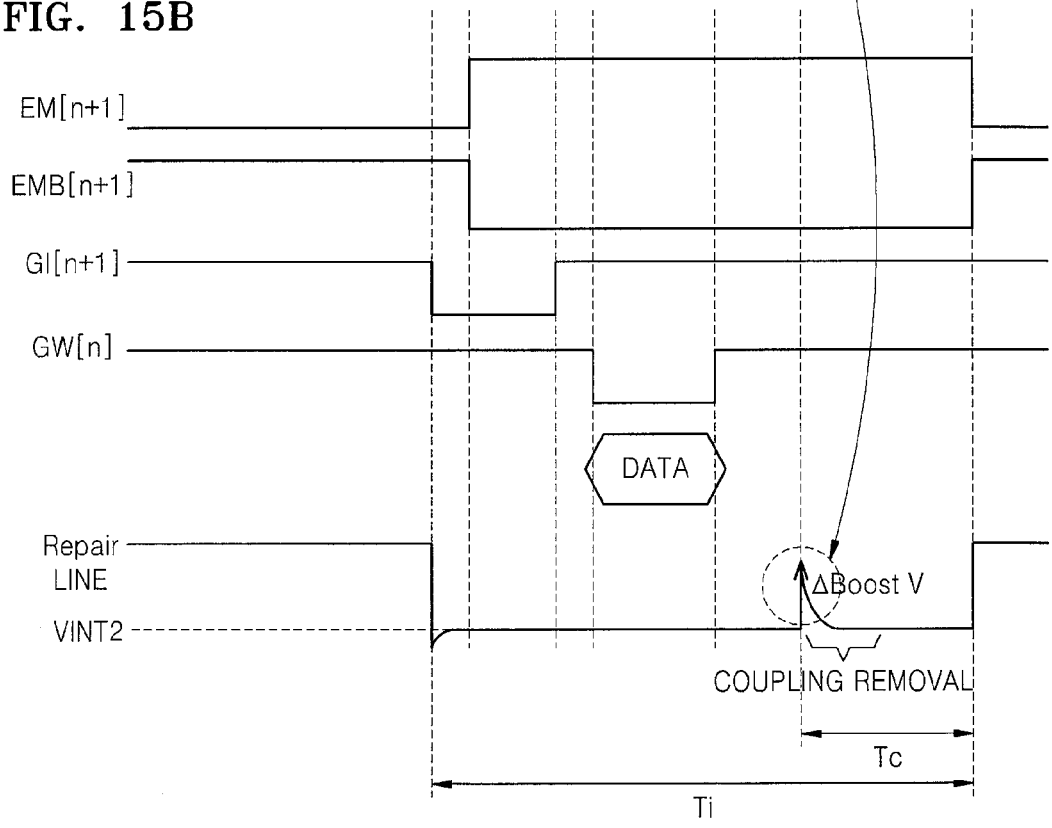

FIG. 14 is a circuit diagram of a dummy pixel DP4 according to another embodiment of the present invention. FIGS. 15A and 15B are timing diagrams for describing an operation of removing coupling by using the dummy pixel DP4 shown in FIG. 14.

The dummy pixel DP4 shown in FIG. 14 is almost the same as the dummy pixel DP3 shown in FIG. 12 except for some partial differences. These differences will now be primarily described.

Referring to FIG. 14, the dummy pixel DP4 includes a dummy circuit DC4 and a coupling removal device coupled to the dummy circuit DC4. The dummy circuit DC4 includes the driving transistor T12, the switching transistor T22, the compensation transistor T32, the initialization transistor T42, the first emission control transistor T52, the second emission control transistor T62, the bypass transistor T72, and the capacitor Cst2. The coupling removal device includes the coupling removal transistor T8.

The gate electrode of the coupling removal transistor T8 is coupled to a coupling control line CRL, the first electrode thereof is coupled to the connection node CN, and the second electrode thereof is coupled to the initialization voltage line IL. In the embodiment shown in FIG. 14, an inverted signal EMB[n+1] of the (n+1)th emission control signal EM[n+1] is applied to the coupling control line CRL as a coupling control signal. A method of inverting the (n+1)th emission control signal EM[n+1] is not so limited and may be implemented in various other ways. For example, an inverter may be provided at the emission control line EMLn+1 corresponding to the (n+1)th row to invert the (n+1)th emission control signal EM[n+1].

Hereinafter, an operation will be described assuming that the pixel P shown in FIG. 5 is a repair pixel, and the light-emitting device E of the repair pixel P is coupled to the dummy pixel DP4 shown in FIG. 14 via the repair line RLn.

FIG. 15A is an operation timing diagram of a pixel P, and FIG. 15B is an operation timing diagram of the dummy pixel DP4. Referring to FIGS. 15A and 15B, the pixel P and the dummy pixel DP4 have the same data write period, but an initialization period and an emission period of the dummy pixel DP4 lag behind those of the pixel P by a set time (e.g., a predetermined time).

In the initialization period of the pixel P, the nth initialization control signal GI[n] is applied at a low level through the initialization control line GILn in the nth row, thereby initializing voltages of anodes of a plurality of pixels P arranged in the nth row to the initialization voltage VINT. In the initialization period Ti of the repair pixel P, the (n+1)th initialization control signal GI[n+1] is applied at a low level through the initialization control line GILn+1 in the (n+1)th row, thereby initializing a voltage of the repair line RLn coupled to an anode of the repair pixel P to the second initialization voltage VINT2. Thereafter, the inverted signal EMB[n+1] is applied at a low level through the coupling control line CRL, thereby making the voltage of the repair line RLn coupled to the anode of the repair pixel P maintain the second initialization voltage VINT2. The initialization period Ti of the repair pixel P includes the coupling removal period Tc.

Thereafter, during the data write period, the nth scan signal GW[n] at the low level is applied to each pixel P and the dummy pixel DP4 through the scan line GWLn corresponding to the nth row, thereby applying the data signal DATA to each pixel P and the dummy pixel DP4. The data signal DATA applied to the dummy pixel DP4 is the data signal DATA to be applied to the repair pixel P.

Thereafter, during the emission period of the pixel P, the nth emission control signal EM[n] is applied at a low level through the emission control line EMLn, thereby changing voltages of the anodes of the plurality of pixels P arranged in the nth row by ΔV2 in response to the data signal DATA. The voltage of the repair line RLn increases by ΔBoostV and becomes "VINT2+ΔBoostV" by the second coupling capacitor CC2 formed between the repair line RLn and the anodes of the plurality of pixels P.

However, during the coupling removal period Tc, the inverted signal EMB[n+1] is applied to the gate electrode of the coupling removal transistor T8 in the dummy pixel DP4, thereby removing a coupling voltage ΔBoostV of the repair line RLn. Accordingly, the repair line RLn returns to the second initialization voltage VINT2. Therefore, when the data signal DATA applied to the dummy pixel DP4 is a black image signal, the repair pixel P may accurately emit light corresponding to a black brightness.

Figure 16:
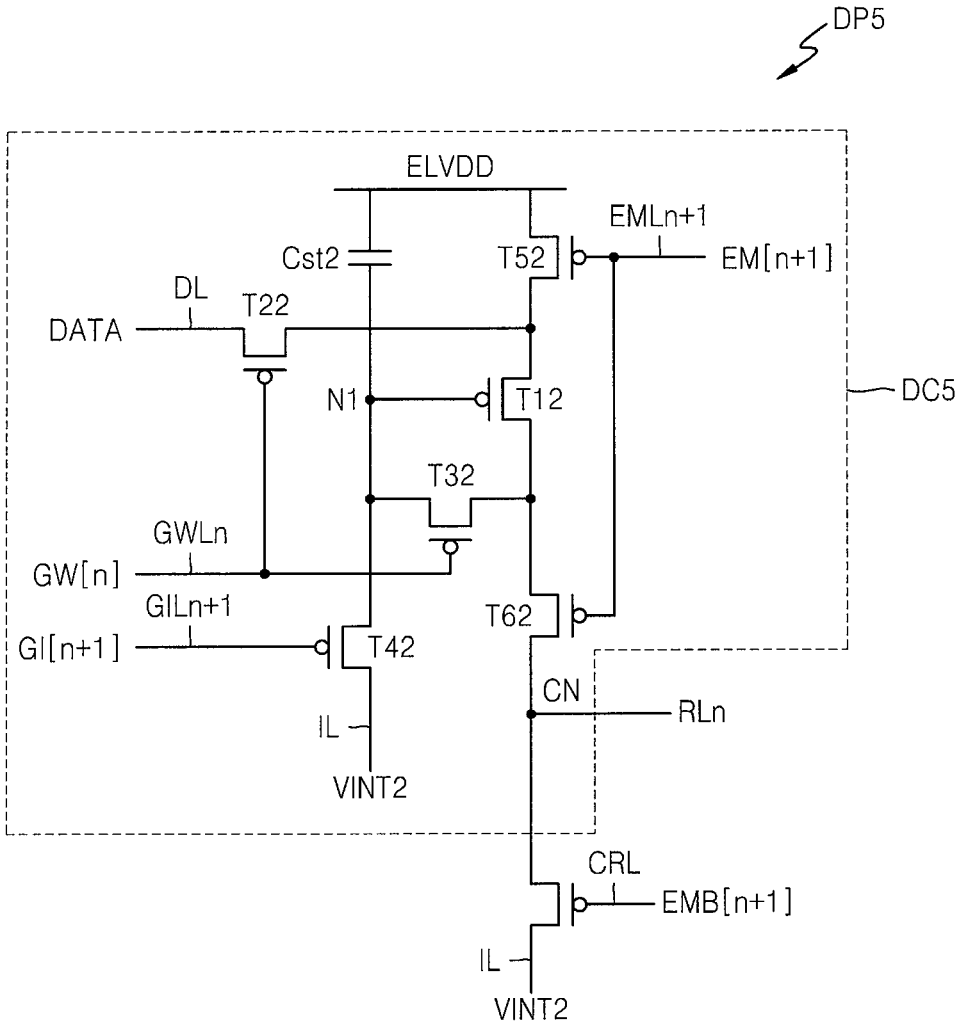
FIG. 16 is a circuit diagram of a dummy pixel according to another embodiment of the present invention.
Figure 17A:
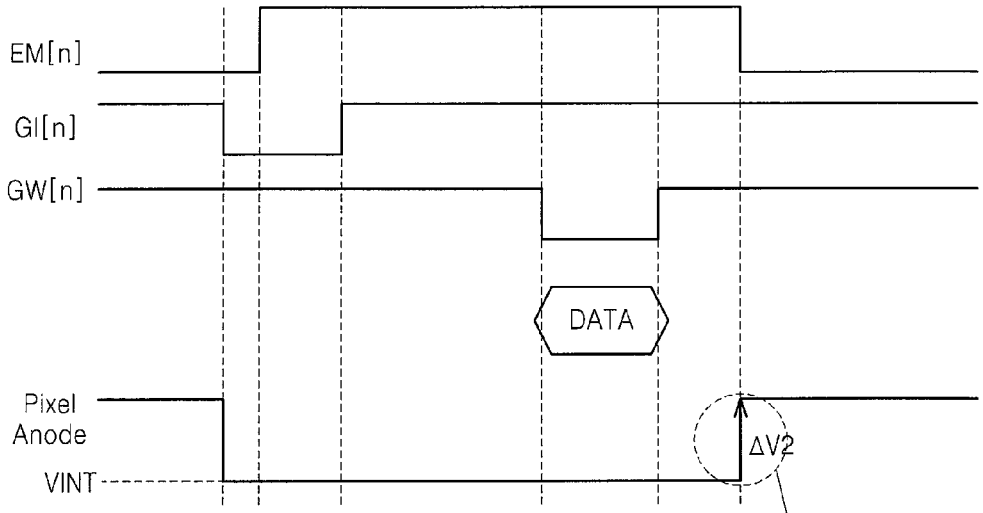
FIGS. 17A and 17B are timing diagrams for describing an operation of removing coupling by using the dummy pixel shown in FIG. 16.
Figure 17B:
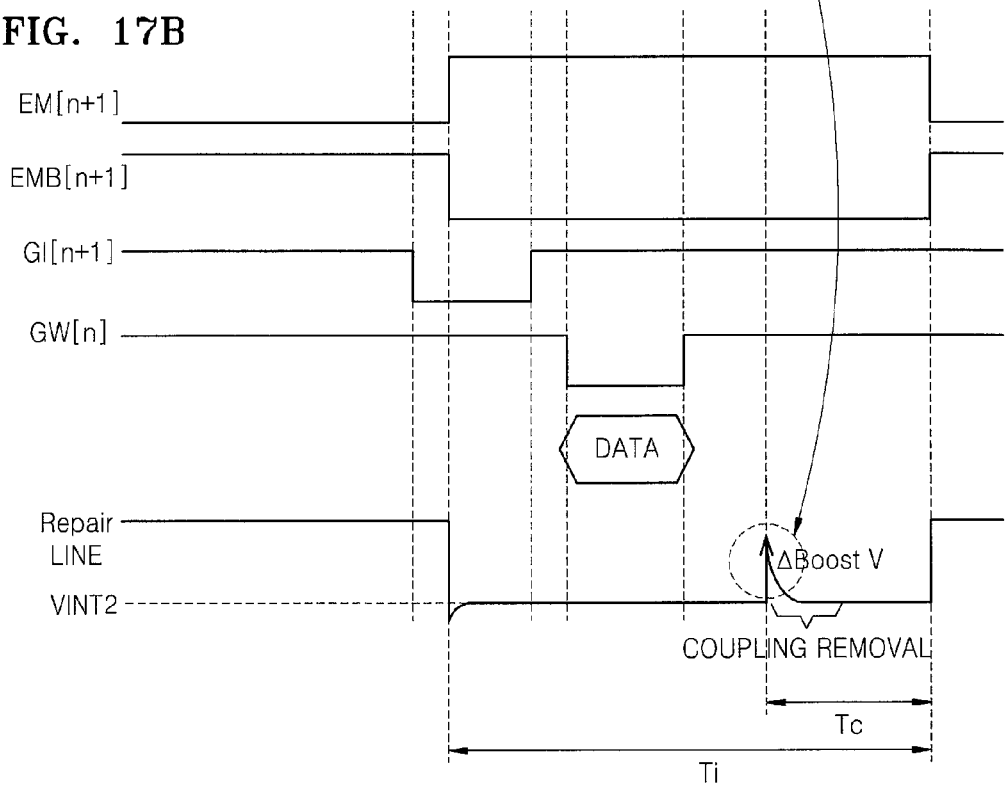

FIG. 16 is a circuit diagram of a dummy pixel DP5 according to another embodiment of the present invention. FIGS. 17A and 17B are timing diagrams for describing an operation of removing coupling by using the dummy pixel DP5 shown in FIG. 16.

The dummy pixel DP5 shown in FIG. 16 is almost the same as the dummy pixel DP4 shown in FIG. 14 except that the bypass transistor T72 is removed, and thus, a detailed description thereof is omitted.

FIG. 17A is an operation timing diagram of a pixel P, and FIG. 17B is an operation timing diagram of the dummy pixel DP5. Referring to FIGS. 17A and 17B, the pixel P and the dummy pixel DP5 have the same data write period, but an initialization period and an emission period of the dummy pixel DP5 lag behind those of the pixel P by a set time (e.g., a predetermined time).

During the initialization period of the pixel P, the nth initialization control signal GI[n] is applied at a low level through the initialization control line GILn in the nth row, thereby initializing voltages of anodes of a plurality of pixels P arranged in the nth row to the initialization voltage VINT. During the initialization period Ti of the repair pixel P, the inverted signal EMB[n+1] is applied at a low level through the coupling control line CRL, thereby initializing a voltage of the repair line RLn coupled to an anode of the repair pixel P to the second initialization voltage VINT2. The initialization period Ti of the repair pixel P includes the coupling removal period Tc.

Thereafter, during the data write period, the nth scan signal GW[n] of the low level is applied to each pixel P and the dummy pixel DP5 through the scan line GWLn corresponding to the nth row, thereby applying the data signal DATA to each pixel P and the dummy pixel DP5. The data signal DATA applied to the dummy pixel DP5 is the data signal DATA to be applied to the repair pixel P.

Thereafter, during the emission period of the pixel P, the nth emission control signal EM[n] is applied at a low level through the emission control line EMLn, thereby changing voltages of the anodes of the plurality of pixels P arranged in the nth row by ΔV2 in response to the data signal DATA. The voltage of the repair line RLn increases by ΔBoostV and becomes "VINT2+ΔBoostV" by the second coupling capacitor CC2 formed between the repair line RLn and the anodes of the plurality of pixels P.

However, during the coupling removal period Tc, the inverted signal EMB[n+1] is applied to the gate electrode of the coupling removal transistor T8 in the dummy pixel DP5, thereby removing a coupling voltage ΔBoostV of the repair line RLn. Accordingly, the repair line RLn returns to the second initialization voltage VINT2. Therefore, when the data signal DATA applied to the dummy pixel DP5 is a black image signal, the repair pixel P may accurately emit light corresponding to a black brightness.

According to the embodiments described above, since a coupling voltage due to a coupling capacitor formed in a repair line may be removed by applying the second initialization voltage VINT2 to the repair line via the coupling removal transistor T8, a repair pixel may accurately emit light of a black brightness. However, when the repair line is excessively initialized to the second initialization voltage VINT2, a repair pixel may have a lower emission brightness than neighboring pixels in a low gradation, thereby causing a low-gradation lock phenomenon that appears as a dark spot.

Figure 18:
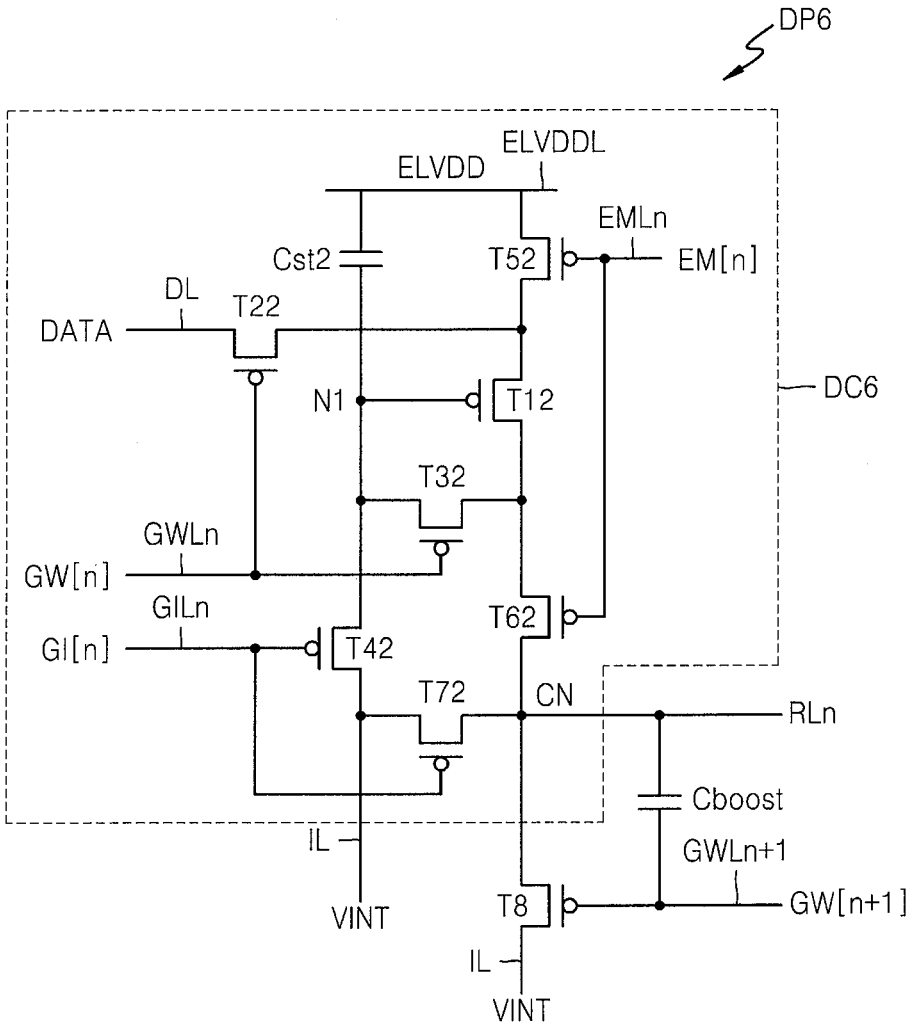
FIG. 18 is a circuit diagram of a dummy pixel according to another embodiment of the present invention.
Figure 19A:
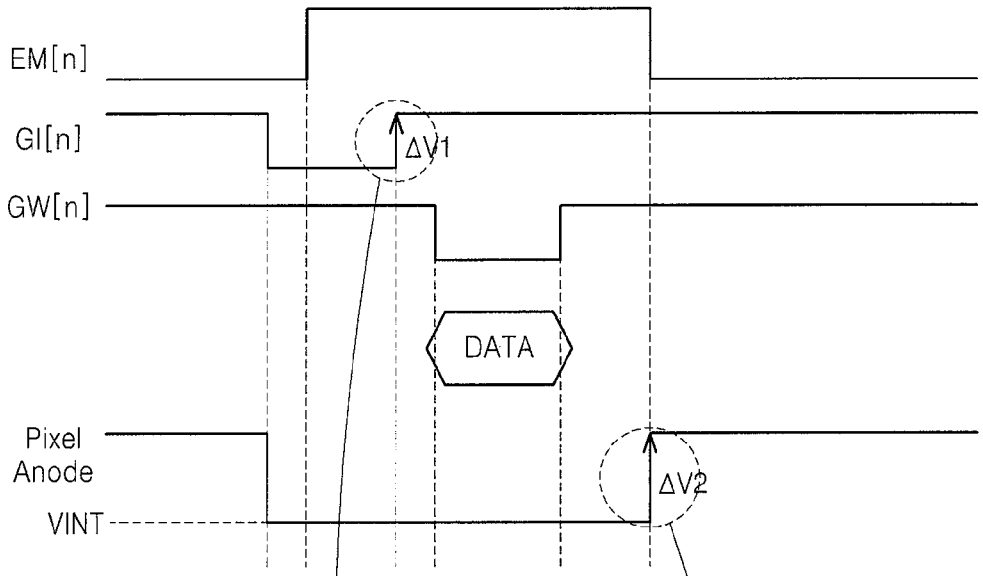
FIGS. 19A and 19B are timing diagrams for describing an operation of removing coupling of a repair line and boosting the repair line by using the dummy pixel shown in FIG. 18.
Figure 19B:
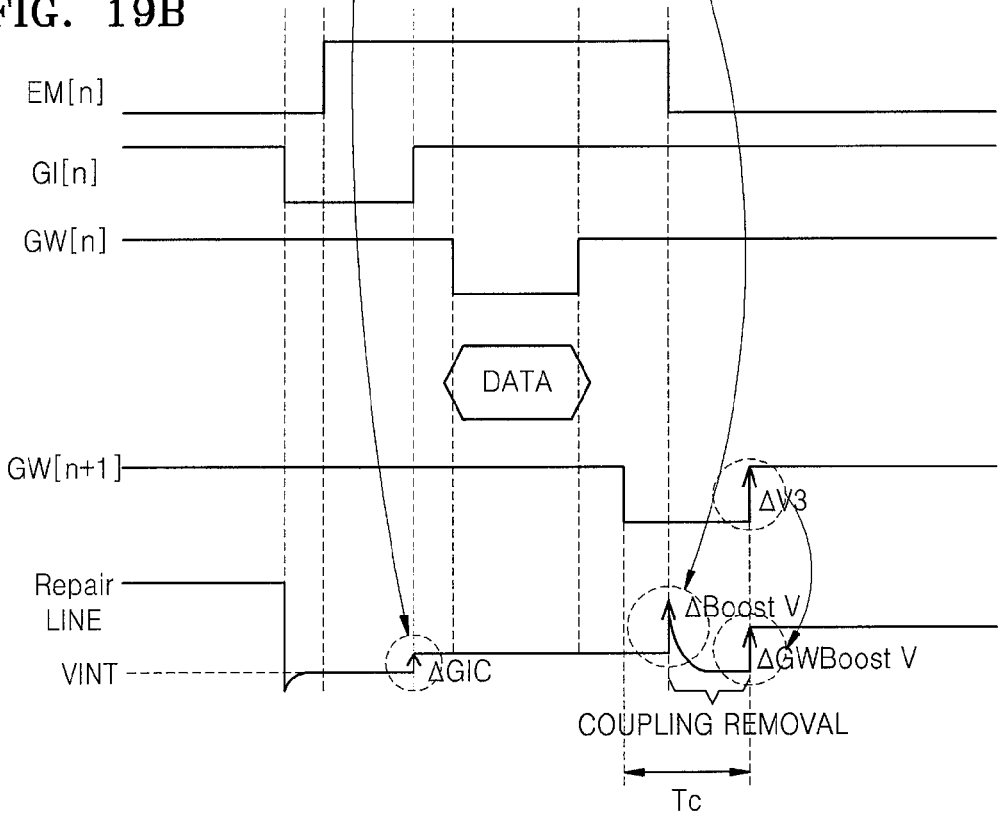

FIG. 18 is a circuit diagram of a dummy pixel DP6 according to another embodiment of the present invention. FIGS. 19A and 19B are timing diagrams for describing an operation of removing coupling of a repair line and boosting the repair line by using the dummy pixel DP6 of FIG. 18.

The dummy pixel DP6 shown in FIG. 18 is almost the same as the dummy pixel DP2 shown in FIG. 9 except for some partial differences. These differences will now be primarily described.

Referring to FIG. 18, the dummy pixel DP6 includes a dummy circuit DC6, and a coupling removal device and a boost device which are coupled to the dummy circuit DC6. The dummy circuit DC6 includes the driving transistor T12, the switching transistor T22, the compensation transistor T32, the initialization transistor T42, the first emission control transistor T52, the second emission control transistor T62, the bypass transistor T72, and the capacitor Cst2. The coupling removal device includes the coupling removal transistor T8. The boost device includes a boost capacitor Cboost.

The initialization transistor T42 and the bypass transistor T72 receive the initialization voltage VINT through the initialization voltage line IL. That is, the dummy pixel DP6 uses the initialization voltage VINT applied to a pixel P. Accordingly, an amplifier and the like for generating the second initialization voltage VINT2 are not used.

The gate electrode of the coupling removal transistor T8 is coupled to a coupling control line, the first electrode thereof is coupled to the connection node CN, and the second electrode thereof is coupled to the initialization voltage line IL. In the embodiment shown in FIG. 18, the coupling control line is the scan line GWLn+1 corresponding to the (n+1)th row, and a coupling control signal is the (n+1)th scan signal GW[n+1]. In another example, the coupling control line may be the scan line GWLn corresponding to the nth row, and the coupling control signal may be the nth scan signal GW[n]. In another example, the coupling control line may be the scan line GWLn+2 corresponding to the (n+2)th row, and the coupling control signal may be the (n+2)th scan signal GW[n+2]. The coupling removal transistor T8 receives the initialization voltage VINT through the initialization voltage line IL.

The boost capacitor Cboost may be provided between the connection node CN (or the repair line RLn) and the coupling control line. The boost capacitor Cboost may prevent the low-gradation lock phenomenon by performing pre-charging in order to increase a potential of the repair line RLn from which a coupling voltage has been removed by the coupling removal transistor T8.

Hereinafter, an operation will be described when the pixel P shown in FIG. 5 is a repair pixel, and the light-emitting device E of the repair pixel P is coupled to the dummy pixel DP6 shown in FIG. 18 via the repair line RLn.

FIG. 19A is an operation timing diagram of a pixel P, and FIG. 19B is an operation timing diagram of the dummy pixel DP6. Referring to FIGS. 19A and 19B, the pixel P and the dummy pixel DP6 have the same data initialization period, write period, and emission period.

During the initialization period, the nth initialization control signal GI[n] is applied at a low level through the initialization control line GILn in the nth row, thereby initializing voltages of anodes of a plurality of pixels P arranged in the nth row and a voltage of the repair line RLn coupled to an anode of the repair pixel P to the initialization voltage VINT.

Thereafter, when a voltage of the nth initialization control signal GI[n] is changed by ΔV1 by transitioning from the low level VGL to the high level VGH, the voltage of the repair line RLn increase by ΔGIC and becomes "VINT+ΔGIC" by the first coupling capacitor CC1 formed between the repair line RLn and the initialization control line GILn.

During the data write period, the nth scan signal GW[n] of the low level is applied to each pixel P and the dummy pixel DP6 through the scan line GWLn corresponding to the nth row, thereby applying the data signal DATA to each pixel P and the dummy pixel DP6. The data signal DATA applied to the dummy pixel DP6 is the data signal DATA to be applied to the repair pixel P.

Thereafter, during the emission period, the nth emission control signal EM[n] is applied at a low level through the emission control line EMLn, thereby changing voltages of the anodes of the plurality of pixels P arranged in the nth row by ΔV2 in response to the data signal DATA. The voltage of the repair line RLn increases by ΔBoostV and becomes "VINT+ΔBoostV" due to the second coupling capacitor CC2 formed between the repair line RLn and the anodes of the plurality of pixels P.

However, during the coupling removal period Tc, the (n+1)th scan signal GW[n+1] is applied through the (n+1)th scan line GWLn+1 to the gate electrode of the coupling removal transistor T8 in the dummy pixel DP6, thereby removing a voltage increase amount "ΔGIC+ΔBoostV" of the repair line RLn. Accordingly, the repair line RLn returns to the initialization voltage VINT.

Thereafter, when the voltage of the (n+1)th scan signal GW[n+1] is changed by "ΔV3=VGH−VGL" by transitioning from the low level VGL to the high level VGH, the voltage of the repair line RLn increases by ΔGWBoost (hereinafter, referred to as a boosting voltage) and becomes "VINT+ΔGWBoost" by the boost capacitor Cboost formed between the repair line RLn and the scan line GWLn+1. Thereafter, the voltage of the repair line RLn increases to a voltage corresponding to the data signal DATA. Accordingly, when the data signal DATA applied to the dummy pixel DP6 is a low-gradation image signal, the repair pixel P may emit light of a corresponding brightness.

A location of the coupling removal period Tc may be controlled by controlling a timing of applying the coupling control signal to the coupling removal transistor T8. That is, for the coupling control signal, the nth scan signal GW[n], the (n+1)th scan signal GW[n+1], or the (n+2)th scan signal GW[n+2] may be used.

The embodiments of the present invention are not limited to the above-described structures of a pixel P and a dummy pixel DP, and the structures of the pixels P and dummy pixels DP may be different.

Figure 20:
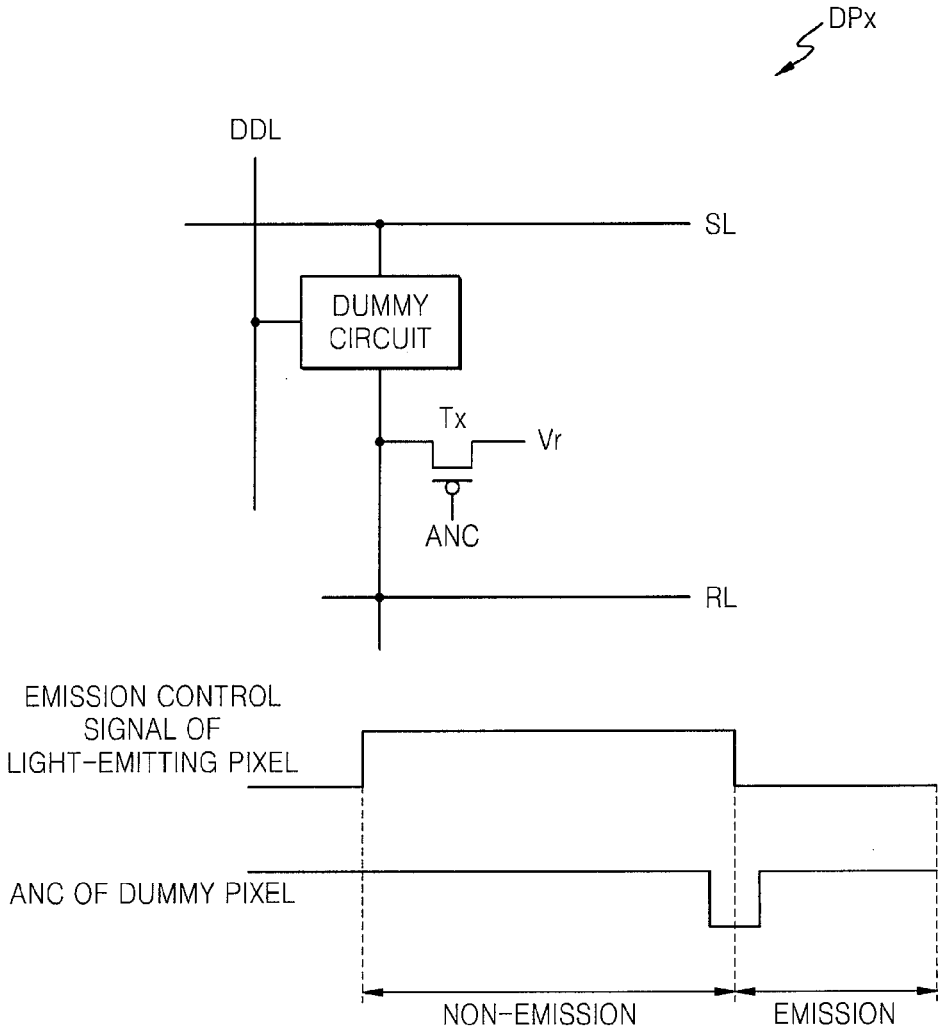
FIG. 20 is a circuit diagram of a dummy pixel according to another embodiment of the present invention.

For example, as shown in FIG. 20, a dummy pixel DPx may include a dummy circuit coupled between a scan line SL and a dummy data line DDL and a coupling removal transistor Tx coupled to the dummy circuit. Although not shown, the dummy circuit is the same as a pixel circuit of a pixel, and each of the dummy circuit and the pixel circuit may include an emission control transistor controlled by an emission control signal. In the dummy pixel DPx, when the emission control transistor is turned on by the emission control signal of the pixel, a control signal ANC may be applied to the coupling removal transistor Tx to turn on the coupling removal transistor Tx, thereby applying an initialization voltage Vr to a repair line RL. Accordingly, a coupling voltage of the repair line RL, by a coupling capacitor formed between the repair line RL and neighboring conductive lines, may be removed, thereby normally exhibiting a black brightness of a repair pixel.

In addition, a boost capacitor may be further included between a gate electrode of the coupling removal transistor Tx and the repair line RL, thereby reducing or preventing occurrence of the low-gradation lock phenomenon (e.g., preventing of the low-gradation lock phenomenon) by pre-charging for boosting the repair line RL from which the coupling voltage has been removed.

In the embodiments described above, a repair when a defective pixel among pixels P in an nth row is coupled to a dummy pixel DP in the nth row through a corresponding repair line RLn has been described as an example. However, the embodiments are not limited thereto and may also be applied to a case where a defective pixel among pixels P in an nth row is coupled to a dummy pixel DP in an (n+1)th row through a repair line RLn corresponding to the nth row.

Although an example where a light-emitting pixel and a dummy pixel are formed with P-type transistors has been described in the embodiments described above, the embodiments of the present invention are not limited thereto. Thus, a pixel may be formed with N-type transistors. In this case, the pixel may be driven by signals obtained by inverting levels of signals to be applied to the P-type transistors.

In the embodiments described above, a case where a dummy pixel is arranged to the left or right has been described as an example. However, the embodiments are not limited thereto and may be applied to an embodiment for removing a coupling voltage of a repair line extended in a column direction due to a coupling capacitor between pixels arranged along the repair line and the repair line when a dummy pixel is arranged at the top or bottom.

As described above, according to the one or more of the above embodiments of the present invention, a defective pixel may be normally driven by easily repairing the defective pixel and reducing (e.g., improving) a brightness deviation between the repaired pixel and a normal pixel, thereby providing a display apparatus having a good display quality of a screen.

It should be understood that the example embodiments described herein should be considered in a descriptive sense only and not for purposes of limitation. Descriptions of features or aspects within each embodiment should typically be considered as available for other similar features or aspects in other embodiments.

While one or more embodiments of the present invention have been described with reference to the figures, it will be understood by those of ordinary skill in the art that various changes in form and details may be made therein without departing from the spirit and scope of the present invention as defined by the following claims, and equivalents thereof.

What is claimed is:

1. A display apparatus comprising:

a plurality of pixels at a display area;

a plurality of dummy pixels at a dummy area; and a plurality of repair lines coupled to the plurality of dummy pixels and connectably arranged to the plurality of pixels, wherein each of the dummy pixels comprises:

a driving transistor configured to output a driving current corresponding to a data signal applied to a gate electrode thereof;

an emission control transistor coupled between a connection node of a corresponding repair line from among the plurality of repair lines and the driving transistor, the emission control transistor being configured to be controlled by an emission control signal;

a bypass transistor coupled between the connection node and a first initialization voltage line through which a first initialization voltage is supplied, the bypass transistor being configured to be controlled by an initialization control signal; and a coupling removal transistor coupled between the connection node and the first initialization voltage line, and coupled to the bypass transistor at the connection node, the coupling removal transistor being configured to be controlled by a coupling control signal applied at a different timing from the initialization control signal.

2. The display apparatus of claim 1, wherein when one of the plurality of dummy pixels is coupled to a defective pixel of the plurality of pixels through a corresponding first repair line of the repair lines, the coupling control signal for turning on the coupling removal transistor is applied in correspondence with a level change time point of a control signal applied to first pixels of the plurality of pixels, which are arranged along the first repair line, through at least one control line arranged in parallel with the first repair line, or in correspondence with an emission time point of the first pixels.

3. The display apparatus of claim 1, wherein the each of the dummy pixels further comprises:

an initialization transistor coupled between the gate electrode of the driving transistor and the first initialization voltage line, the initialization transistor being configured to be controlled by the initialization control signal;

a switching transistor coupled between a data line through which the data signal is applied and a first electrode of the driving transistor, the switching transistor being configured to be controlled by a scan signal; and a compensation transistor coupled between the gate electrode and a second electrode of the driving transistor, the compensation transistor being configured to be controlled by the scan signal.

4. The display apparatus of claim 3, wherein the coupling control signal is the scan signal, a first next scan signal following the scan signal after one unit of time, or a second next scan signal following the scan signal after two units of time.

5. The display apparatus of claim 3, wherein, in each of the dummy pixels, the initialization transistor and the bypass transistor are configured to be turned on during an initialization period and to initialize the gate electrode of the driving transistor and the corresponding repair line coupled to the connection node, the switching transistor and the compensation transistor are configured to be turned on during a data write period and to apply a dummy data signal in which a threshold value of the driving transistor is compensated for to the gate electrode of the driving transistor, the emission control transistor is configured to be turned on during an emission period and to output the driving current to the corresponding repair line, and the coupling removal transistor is turned on during a coupling removal period and to remove a coupling voltage from the initialized corresponding repair line.

6. The display apparatus of claim 1, wherein each of the pixels comprises:

a second driving transistor configured to output a driving current corresponding to a data signal applied to a gate electrode thereof;

a second emission control transistor coupled between the second driving transistor and a light-emitting device, the second emission transistor being configured to be controlled by a second emission control signal;

a second bypass transistor coupled between the light-emitting device and a second initialization voltage line through which a second initialization voltage is supplied, the second bypass transistor being configured to be controlled by a second initialization control signal;

a second initialization transistor coupled between the gate electrode of the second driving transistor and the second initialization voltage line, the second initialization transistor being configured to be controlled by the second initialization control signal;

a second switching transistor coupled between a data line through which the data signal is applied and a first electrode of the second driving transistor, the second switching transistor being configured to be controlled by a second scan signal; and a second compensation transistor coupled between the gate electrode and a second electrode of the second driving transistor, the second compensation transistor being configured to be controlled by the second scan signal, wherein the second initialization voltage is higher than the first initialization voltage.

7. The display apparatus of claim 6, wherein the second emission control signal is an nth emission control signal, and the emission control signal is the nth emission control signal or an (n+1)th emission control signal, the second initialization control signal is an nth initialization control signal, and the initialization control signal is the nth initialization control signal or an (n+1)th initialization control signal, and the second scan signal and the scan signal are an nth scan signal.

8. The display apparatus of claim 1, wherein each of the dummy pixels further comprises a boost capacitor coupled between a gate electrode of the coupling removal transistor and the corresponding repair line.

9. The display apparatus of claim 8, wherein each of the dummy pixels further comprises:

an initialization transistor coupled between the gate electrode of the driving transistor and the first initialization voltage line, the initialization transistor being configured to be controlled by the initialization control signal;

a switching transistor coupled between a data line through which a dummy data signal is applied and a first electrode of the driving transistor, the switching transistor being configured to be controlled by a scan signal; and a compensation transistor coupled between the gate electrode and a second electrode of the driving transistor, the compensation transistor being configured to be controlled by the scan signal.

10. The display apparatus of claim 9, wherein the coupling control signal is the scan signal, a first next scan signal following the scan signal after one unit of time, or a second next scan signal following the scan signal after two units of time.

11. The display apparatus of claim 9, wherein in each of the dummy pixels, the initialization transistor and the bypass transistor are configured to be turned on during an initialization period and to initialize the gate electrode of the driving transistor and the corresponding repair line coupled to the connection node, the switching transistor and the compensation transistor are configured to be turned on during a data write period and to apply a dummy data signal in which a threshold value of the driving transistor is compensated to the gate electrode of the driving transistor, the emission control transistor is configured to be turned on during an emission period and to output the driving current to the corresponding repair line, the coupling removal transistor is configured to be turned on during a coupling removal period and to remove a coupling voltage of the initialized corresponding repair line, and the boost capacitor is configured to boost the corresponding repair line after the coupling removal period.

12. The display apparatus of claim 9, wherein each of the pixels comprises:

a second driving transistor configured to output a driving current corresponding to a data signal applied to a gate electrode thereof;

a second emission control transistor coupled between the second driving transistor and a light-emitting device, the second emission control transistor being configured to be controlled by a second emission control signal;

a second bypass transistor coupled between the light-emitting device and a second initialization voltage line through which a second initialization voltage is supplied, the second bypass transistor being configured to be controlled by a second initialization control signal;

a second initialization transistor coupled between the gate electrode of the second driving transistor and the second initialization voltage line, the second initialization transistor being configured to be controlled by the second initialization control signal;

a second switching transistor coupled between a data line through which the data signal is applied and a first electrode of the second driving transistor, the second switching transistor being configured to be controlled by a second scan signal; and a second compensation transistor coupled between the gate electrode and a second electrode of the second driving transistor, the second compensation transistor being configured to be controlled by the second scan signal, wherein the second initialization voltage is the same as the first initialization voltage.

13. A display apparatus comprising:

a plurality of pixels at a display area;

a plurality of dummy pixels at a non-display area; and a plurality of repair lines coupled to the plurality of dummy pixels and connectably arranged to the plurality of pixels, wherein each of the dummy pixels comprises:

a dummy circuit configured to output a driving current corresponding to a data signal to a coupled corresponding repair line;

a coupling removal transistor coupled to the coupled corresponding repair line and configured to be turned on in correspondence with a level change time point of a control signal applied to first pixels of the plurality of pixels, which are arranged along the corresponding repair line, through at least one control line arranged in parallel with the corresponding repair line, or in correspondence with an emission time point of the first pixels; and a boost capacitor coupled between a gate electrode of the coupling removal transistor and the corresponding repair line, the boost capacitor being configured to increase a potential of the repair line.

* * * * *